US011621477B2

(12) United States Patent
Tsuchida

(10) Patent No.: US 11,621,477 B2
(45) Date of Patent: Apr. 4, 2023

(54) ANTENNA DEVICE AND ANTENNA APPARATUS

(71) Applicant: HIROSE ELECTRIC CO., LTD., Kanagawa (JP)

(72) Inventor: Masahiro Tsuchida, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 34 days.

(21) Appl. No.: 17/518,760

(22) Filed: Nov. 4, 2021

(65) Prior Publication Data

US 2022/0149512 A1 May 12, 2022

(30) Foreign Application Priority Data

Nov. 10, 2020 (JP) ..... JP2020-187497

(51) Int. Cl.

| | |
|---|---|
| ***H01Q 1/32*** | (2006.01) |
| ***H01Q 1/52*** | (2006.01) |
| ***H01Q 23/00*** | (2006.01) |
| ***H01Q 25/00*** | (2006.01) |
| ***H01Q 1/50*** | (2006.01) |

(52) U.S. Cl.

CPC ..... *H01Q 1/3275* (2013.01); *H01Q 1/50* (2013.01); *H01Q 1/526* (2013.01); *H01Q 23/00* (2013.01); *H01Q 25/005* (2013.01)

(58) Field of Classification Search

CPC .... H01Q 1/1207; H01Q 1/3275; H01Q 1/526; H01Q 1/50; H01Q 23/00; H01Q 25/005; H01R 2201/02; H01R 2201/26

See application file for complete search history.

(56) References Cited

U.S. PATENT DOCUMENTS

| | | | | |
|---|---|---|---|---|
| 2019/0089419 | A1* | 3/2019 | Kim | H01Q 21/28 |
| 2020/0168982 | A1 | 5/2020 | Asuma et al. | |
| 2022/0006178 | A1* | 1/2022 | Shimura | H01Q 1/42 |
| 2022/0320775 | A1* | 10/2022 | Kato | H01R 13/6594 |

FOREIGN PATENT DOCUMENTS

| | | | |
|---|---|---|---|
| JP | 2019-29873 | A | 2/2019 |

* cited by examiner

*Primary Examiner* — Robert Karacsony

(74) *Attorney, Agent, or Firm* — Rankin, Hill & Clark LLP

(57) ABSTRACT

Provided is an antenna device includes a base connector fixed to a support substrate, a module connector connected to the base connector to the base connector, and an antenna module fixed to the module connector and configured to transmit or receive a radio wave. The base connector includes a base-side casing, a base-side fitting portion, and multiple base-side terminals. The module connector includes a module-side casing, a module-side fitting portion, and a multiple module-side terminals. The antenna module includes an antenna substrate and an antenna element provided on a front surface of the antenna substrate. In a state in which the base connector is fixed to the support substrate and the module connector is connected to the base connector, the antenna module is fixed to the module-side casing such that the front surface of the antenna substrate faces up diagonally to the outside of the module connector.

11 Claims, 12 Drawing Sheets

ANTENNA DEVICE AND ANTENNA APPARATUS

CROSS-REFERENCE TO RELATED APPLICATION

This application claims priority from Japanese Patent Application No. 2020-187497 filed with the Japan Patent Office on Nov. 10, 2020, the entire content of which is hereby incorporated by reference.

BACKGROUND

1. Technical Field

The present disclosure relates to an antenna device and an antenna apparatus used for transmitting or receiving a radio wave with a quasi-millimeter wave band or a millimeter wave band.

2. Related Art

Typically, an antenna for an AM/FM radio, an antenna for a global navigation satellite system (GNSS) used for, e.g., car navigation and the like are provided at an automobile. Recently, an antenna for long term evolution (LTE) used for, e.g., vehicle-to-everything (V2X) communication is provided at the automobile in some cases.

JP-A-2019-29873 describes an antenna apparatus configured such that multiple antennas are provided in a shark fin (a shark-fin-like case) provided on a roof of an automobile. This antenna apparatus includes an antenna for a satellite digital radio, an antenna for a global positioning system (GPS), and an antenna for communication with a radio base station of a mobile phone network, and these antennas are arranged on a substrate provided at a base supporting the shark fin on the roof.

SUMMARY

An antenna device according to the present invention is an antenna device provided on an attachment surface of a support substrate and used for transmitting or receiving a radio wave with a quasi-millimeter wave band or a millimeter wave band. The antenna device includes a base connector fixed to the support substrate, a module connector connected to the base connector to be insertable into or extractable from the base connector, and an antenna module fixed to the module connector and configured to transmit or receive the radio wave with the quasi-millimeter wave band or the millimeter wave band. The base connector includes a base-side casing of which a lower end side is fixed to the support substrate, a base-side fitting portion provided on an upper end side of the base-side casing and fitted onto a module-side fitting portion of the module connector, and multiple base-side terminals provided in the base-side casing and connecting a substrate-side circuit provided on the support substrate and multiple module-side terminals of the module connector to each other. The module connector includes a module-side casing, the module-side fitting portion provided on a lower end side of the module-side casing and fitted in the base-side fitting portion, and the multiple module-side terminals provided in the module-side casing and connecting the multiple base-side terminals and the antenna module to each other. The antenna module includes an antenna substrate and an antenna element provided on a front surface of the antenna substrate and configured to transmit or receive the radio wave with the quasi-millimeter wave band or the millimeter wave band. In a state in which the base connector is fixed to the support substrate and the module connector is connected to the base connector, the antenna module is fixed to the module-side casing such that the front surface of the antenna substrate faces up diagonally to the outside of the module connector.

DETAILED DESCRIPTION

Figure 1:
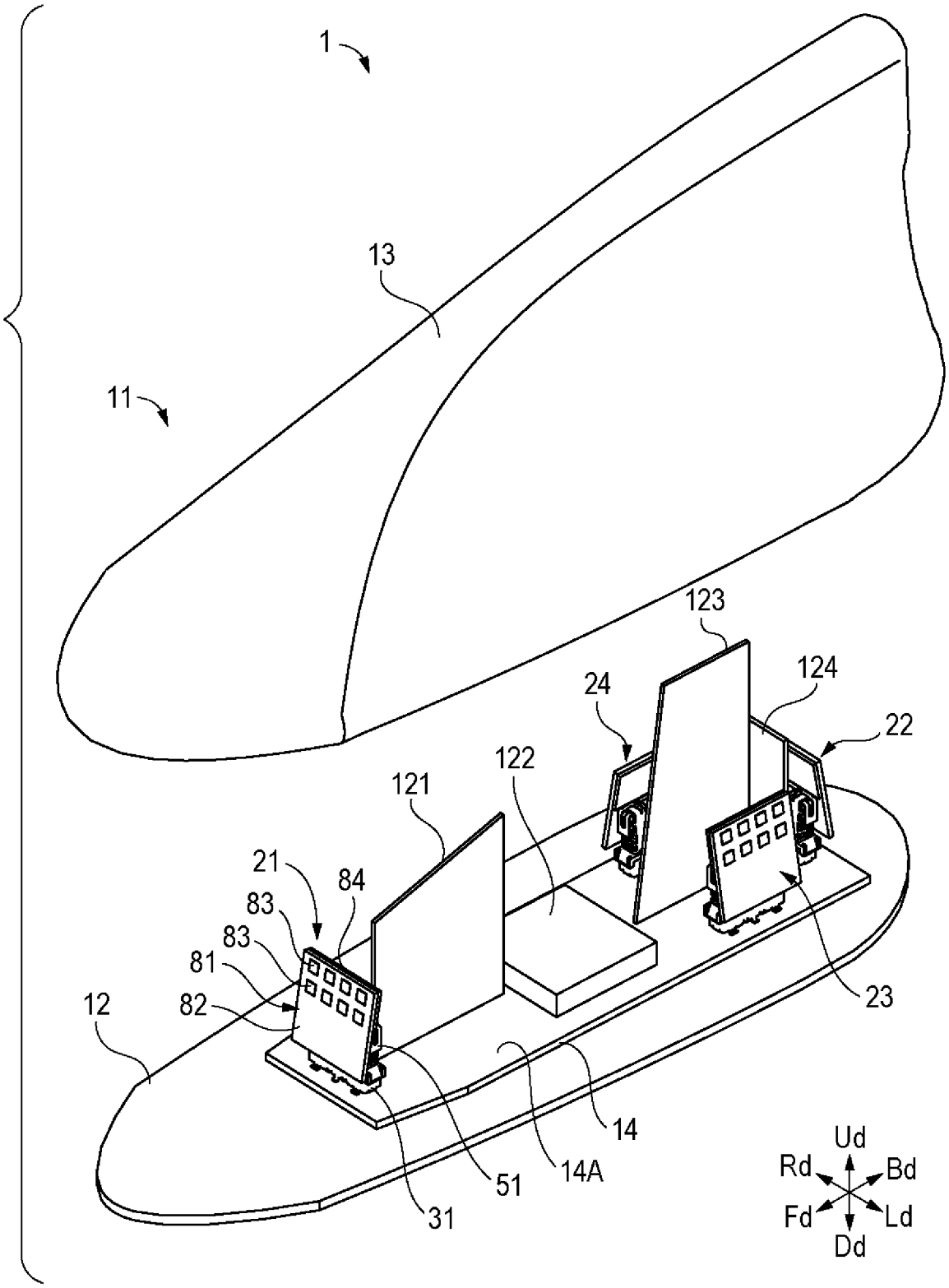
FIG. 1 is a perspective view showing an antenna apparatus of an embodiment of the present invention in a state in which a cover is separated from a base of a case.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Currently, a technique for connecting an automobile to a fifth-generation mobile communication system (5G) to achieve high-speed, high-capacity, low-latency communication between the automobile and the outside thereof has been developed. As part thereof, study has been conducted on an antenna being provided on the automobile for the purpose of performing communication by means of a radio wave with Sub6 (3.6 GHz to 6 GHz), a quasi-millimeter wave band (20 GHz to 30 GHz), or a millimeter wave band (30 GHz to 300 GHz). Hereinafter, for the sake of convenience in description, an antenna for transmitting or receiving the radio wave with the quasi-millimeter wave band or the millimeter wave band will be referred to as a "millimeter-wave antenna."

The radio wave with the quasi-millimeter wave band or the millimeter wave band has a high frequency, and for this reason, the radio wave transmitted from the outside of the automobile is blocked by, e.g., a metal body of the automobile and is less likely to be received by the automobile. Thus, the millimeter-wave antenna needs to be attached facing the outside of the automobile. For this reason, the millimeter-wave antenna device may be arranged inside a resin shark fin provided on a roof of the automobile. The radio wave with the quasi-millimeter wave band or the millimeter wave band shows a greater radio wave propagation loss as compared to a radio wave having a frequency band lower than the quasi-millimeter wave band, and is greatly attenuated due to, e.g., raining. For this reason, the millimeter-wave antenna preferably uses an array antenna to enhance an antenna gain. Since the automobile as a mobile object frequently changes the orientation of a vehicle body, the automobile needs to receive a radio wave from the outside across a wide area. For this reason, multiple millimeter-wave antennas may be provided in the shark fin, and the multiple millimeter-wave antennas may be arranged in different orientations. For example, a method is conceivable, in which four millimeter-wave antennas are arranged such that the orientations thereof are toward the front, the back, the right, and the left. Further, since the automobile travels on the ground while the radio base station is placed at a high position such as a building or a pole, each millimeter-wave antenna may be arranged inclined upward to face the radio base station.

A substrate for fixing the antennas is provided in the shark fin. Normally, the substrate is arranged such that a component mounting surface thereof is substantially horizontal. In a case where each millimeter-wave antenna is arranged inclined upward in the shark fin, each millimeter-wave antenna in the upwardly-inclined state needs to be firmly supported on the substantially-horizontal component mounting surface of the substrate such that the orientation of the millimeter-wave antenna is not changed due to, e.g., vibration while the automobile is traveling.

Each millimeter-wave antenna is connected to a communication apparatus provided in the automobile via a circuit (e.g., wires formed on a surface of the substrate) formed on the substrate provided in the shark fin, cables connected to the circuit on the substrate with connectors, or the like In the case of performing communication by means of the radio wave with the quasi-millimeter wave band or the millimeter wave band, a signal transferred between the communication apparatus in the automobile and each millimeter-wave antenna is also a high-frequency signal with several GHz. Thus, if there is impedance mismatch between each millimeter-wave antenna and the substrate, e.g., a reflection loss increases, the high-frequency signal transferred between the communication apparatus in the automobile and each millimeter-wave antenna is degraded, and the quality of communication is degraded.

On this point, in the antenna apparatus described in JP-A-2019-29873, the antenna for performing communication with the radio base station of the mobile phone network is connected to the circuit on the substrate by soldering. In a case where connection between the antenna and the substrate is soldering manually performed using a soldering gun, an impedance between the antenna and the circuit on the substrate varies according to the amount of solder on a connection portion between the antenna and the circuit on the substrate, and for this reason, impedance mismatch is likely to be caused between the antenna and the circuit on the substrate. In the antenna apparatus described in JP-A-2019-29873, the antenna connected to the circuit on the substrate by soldering is an antenna for transmitting or receiving the radio wave having the frequency lower than the quasi-millimeter wave band, and for this reason, influence of the impedance mismatch due to variation in the solder amount on the quality of communication is not so great. However, in the case of the millimeter-wave antenna, such influence of the impedance mismatch due to variation in the solder amount on the quality of communication increases. For this reason, manual soldering is not preferred as the method for connecting the millimeter-wave antenna to the circuit on the substrate provided in the shark fin, and another method capable of reducing the impedance mismatch between the millimeter-wave antenna and the circuit on the substrate is required.

The present invention has been made in response to, e.g., the above-described demand, and an object of the present invention is to provide an antenna device and an antenna apparatus capable of firmly supporting, on a support substrate, an antenna module configured to transmit or receive a radio wave with a quasi-millimeter wave band or a millimeter wave band and reducing impedance mismatch between the antenna module and a circuit on the support substrate.

For achieving the above-described object, the antenna device of the present invention is an antenna device provided on an attachment surface of a support substrate and used for transmitting or receiving a radio wave with a quasi-millimeter wave band or a millimeter wave band. The antenna device includes a base connector fixed to the support substrate, a module connector connected to the base connector to be insertable into or extractable from the base connector, and an antenna module fixed to the module connector and configured to transmit or receive the radio wave with the quasi-millimeter wave band or the millimeter wave band. The base connector includes a base-side casing of which a lower end side is fixed to the support substrate, a base-side fitting portion provided on an upper end side of the base-side casing and fitted onto a module-side fitting portion of the module connector, and multiple base-side terminals provided in the base-side casing and connecting a substrate-side circuit provided on the support substrate and multiple module-side terminals of the module connector to each other. The module connector includes a module-side casing, the module-side fitting portion provided on a lower end side of the module-side casing and fitted in the base-side fitting portion, and the multiple module-side terminals provided in the module-side casing and connecting the multiple base-side terminals and the antenna module to each other. The antenna module includes an antenna substrate and an antenna element provided on a front surface of the antenna substrate and configured to transmit or receive the radio wave with the quasi-millimeter wave band or the millimeter wave band. In a state in which the base connector is fixed to the support substrate and the module connector is connected to the base connector, the antenna module is fixed to the module-side casing such that the front surface of the antenna substrate faces up diagonally to the outside of the module connector.

In the antenna device of the above-described aspect of the present invention, the following configuration can be employed: in a state in which the base connector is fixed to the support substrate, the base-side fitting portion and the module-side fitting portion are formed such that an insertion/extraction direction of the module connector with respect to the base connector is perpendicular to the attachment surface of the support substrate, and the antenna module is fixed to the module-side casing such that the front surface of the antenna substrate is inclined with respect to the insertion/extraction direction. Instead, the following configuration may be employed: in a state in which the base connector is fixed to the support substrate, the base-side fitting portion and the module-side fitting portion are formed such that the insertion/extraction direction of the module connector with respect to the base connector is inclined with respect to the attachment surface of the support substrate, and the antenna module is fixed to the module-side casing such that the front surface of the antenna substrate is parallel with the insertion/extraction direction.

In the antenna device of the above-described aspect of the present invention, the antenna module may include an antenna circuit provided on the antenna substrate and configured to perform signal processing relating to transmission or reception of the radio wave with the quasi-millimeter wave band or the millimeter wave band; and the multiple base-side terminals may include a base-side transmission terminal for transferring a transmission signal from the substrate-side circuit to the antenna circuit, a base-side reception terminal for transferring a reception signal from the antenna circuit to the substrate-side circuit, and a base-side power supply terminal for supplying power from the substrate-side circuit to the antenna circuit, and the multiple module-side terminals may include a module-side transmission terminal for transferring a transmission signal from the substrate-side circuit to the antenna circuit, a module-side reception terminal for transferring a reception signal from the antenna circuit to the substrate-side circuit, and a module-side power supply terminal for supplying power from the substrate-side circuit to the antenna circuit. In this case, the base connector may include a first base-side separate shield member made of a conductive material and surrounding an outer peripheral side of the base-side transmission terminal to separately electromagnetically shield the base-side transmission terminal, and a second base-side separate shield member made of a conductive material and surrounding an outer peripheral side of the base-side reception terminal to separately electromagnetically shield the base-side reception terminal. The module connector may include a first module-side separate shield member made of a conductive material and surrounding an outer peripheral side of the module-side transmission terminal to separately electromagnetically shield the module-side transmission terminal, and a second module-side separate shield member made of a conductive material and surrounding an outer peripheral side of the module-side reception terminal to separately electromagnetically shield the module-side reception terminal.

In the antenna device of the above-described aspect of the present invention, the base-side casing may be made of an insulating material and be provided with a base-side overall shield member made of a conductive material and collectively covering the multiple base-side terminals to entirely electromagnetically shield the multiple base-side terminals, and the module-side casing may be made of an insulating material and be provided with a module-side overall shield member made of a conductive material and collectively covering the multiple module-side terminals to entirely electromagnetically shield the multiple module-side terminals.

The antenna device of the above-described aspect of the present invention may further includes a lock mechanism configured to lock, when the base-side fitting portion and the module-side fitting portion are fitted to each other, the module connector to the base connector such that the module connector is not separated from the base connector.

An antenna apparatus of a first aspect of the present invention is an antenna apparatus provided at a vehicle and used for radio communication between a communication apparatus provided at the vehicle and a communication apparatus provided at an object other than the vehicle. The antenna apparatus includes a support substrate, multiple antenna devices provided on an attachment surface of the support substrate, and a case housing the support substrate and the multiple antenna devices. The multiple antenna devices include multiple millimeter-wave antenna devices configured to transmit or receive a radio wave with a quasi-millimeter wave band or a millimeter wave band, and a non-millimeter-wave antenna device configured to transmit or receive a radio wave with a frequency band lower than the quasi-millimeter wave band. The multiple millimeter-wave antenna devices are the antenna devices of the above-described aspect of the present invention. The multiple millimeter-wave antenna devices are, on the attachment surface of the support substrate, arranged in a region outside a region where the non-millimeter-wave antenna device is arranged.

In the antenna apparatus of the first aspect of the present invention, the multiple millimeter-wave antenna devices may include a first millimeter-wave antenna device, a second millimeter-wave antenna device, a third millimeter-wave antenna device, and a fourth millimeter-wave antenna device, the first millimeter-wave antenna device may be arranged at the front of the non-millimeter-wave antenna device, the second millimeter-wave antenna device may be arranged at the back of the non-millimeter-wave antenna device, the third millimeter-wave antenna device may be arranged at the left of the non-millimeter-wave antenna device, and the fourth millimeter-wave antenna device may be arranged at the right of the non-millimeter-wave antenna device. In the antenna apparatus of the above-described aspect of the present invention, the first millimeter-wave antenna device may be arranged on the frontmost side among the multiple antenna devices, the second millimeter-wave antenna device may be arranged on the backmost side among the multiple antenna devices, the third millimeter-wave antenna device may be arranged on the leftmost side among the multiple antenna devices, and the fourth millimeter-wave antenna device may be arranged on the rightmost side among the multiple antenna devices.

An antenna apparatus of a second aspect of the present invention is an antenna apparatus provided at a vehicle and used for radio communication between a communication apparatus provided at the vehicle and a communication apparatus provided at an object other than the vehicle. The antenna apparatus includes a support substrate, multiple millimeter-wave antenna devices configured to transmit or receive a radio wave with a quasi-millimeter wave band or a millimeter wave band, and a case housing the support substrate and the multiple millimeter-wave antenna devices. Each millimeter-wave antenna device includes a base connector fixed to the support substrate, a module connector connected to the base connector to be insertable into or extractable from the base connector, an antenna module configured to transmit or receive the radio wave with the quasi-millimeter wave band or the millimeter wave band, and a cable connecting the module connector and the antenna module to each other. The base connector includes a base-side casing of which a lower end side is fixed to the support substrate, a base-side fitting portion provided on an upper end side of the base-side casing and fitted onto a module-side fitting portion of the module connector, and multiple base-side terminals provided in the base-side casing and connecting a substrate-side circuit provided on the support substrate and multiple module-side terminals of the module connector to each other. The module connector includes a module-side casing, the module-side fitting portion provided on a lower end side of the module-side casing and fitted in the base-side fitting portion, and the multiple module-side terminals provided in the module-side casing and connecting the multiple base-side terminals and multiple electric wires of the cable to each other. The cable includes the multiple electric wires connecting the multiple module-side terminals and the antenna module to each other. The antenna module includes an antenna substrate and an antenna element provided on a front surface of the antenna substrate and configured to transmit or receive the radio wave with the quasi-millimeter wave band or the millimeter wave band. The antenna module of each millimeter-wave antenna device is attached to the case such that the front surface of the antenna substrate faces an inner surface of the case and faces diagonally upward.

According to the present invention, the antenna module configured to transmit or receive the radio wave with the quasi-millimeter wave band or the millimeter wave band can be firmly supported on the support substrate, and the impedance mismatch between the antenna module and the circuit on the support substrate can be reduced.

(Antenna Apparatus)

An embodiment of an antenna apparatus of the present invention will be described. FIG. 1 shows an antenna apparatus 1 of the embodiment of the present invention. In FIG. 1, a cover 13 of a case 11 is separated from a base 12 of the case 11 so that the inside of the antenna apparatus 1 can be viewed. Note that up (Ud), down (Dd), front (Fd), back (Bd), right (Rd), and left (Ld) directions of the antenna apparatus 1 are according to arrows shown on the lower right side in FIGS. 1 and 2 or FIG. 15.

The antenna apparatus 1 is, for example, provided on an upper portion of a roof of a vehicle such as an automatic four-wheeled vehicle. The antenna apparatus 1 is, for example, a shark fin antenna. The antenna apparatus 1 is used for radio communication between a communication apparatus mounted on the vehicle and a communication apparatus (e.g., a radio base station of a mobile communication system) provided at an object other than the vehicle. Hereinafter, the vehicle on which the antenna apparatus 1 is provided will be referred to as a "subject vehicle."

As shown in FIG. 1, the antenna apparatus 1 includes the case 11, a support substrate 14, multiple millimeter-wave antenna devices 21 to 24, and multiple non-millimeter-wave antenna devices 121 to 124.

The case 11 includes the base 12 and the cover 13 covering the base 12 from above. The base 12 is formed in a flat plate shape. The cover 13 is formed in a bottomless box shape, and has a shark-fin-like outer appearance. Moreover, at least the cover 13 is, for example, made of an insulating material such as resin. The base 12 is fixed to an upper portion of a roof of the subject vehicle, and the cover 13 is fixed to the base 12. In the case 11, the support substrate 14, the multiple millimeter-wave antenna devices 21 to 24, and the multiple non-millimeter-wave antenna devices 121 to 124 are housed.

The support substrate 14 is fixed onto the base 12. Moreover, the support substrate 14 is arranged such that an upper surface 14A (an attachment surface) of the support substrate 14 is substantially horizontal when the subject vehicle is present on a horizontal ground. The millimeter-wave antenna devices 21 to 24 and the non-millimeter-wave antenna devices 121 to 124 are fixed to the upper surface 14A of the support substrate 14. Further, the support substrate 14 is, for example, a printed-circuit board. On the support substrate 14, wires for connecting the millimeter-wave antenna devices 21 to 24 and the non-millimeter-wave antenna devices 121 to 124 to a communication apparatus, a power source, and the like mounted on the subject vehicle are formed. The wires formed on the support substrate 14 are, for example, connected to the communication apparatus, the power source and the like mounted on the subject vehicle via connectors and cables.

Each of the millimeter-wave antenna devices 21 to 24 is an antenna device configured to transmit or receive a radio wave with a quasi-millimeter wave band or a millimeter wave band. Each of the millimeter-wave antenna devices 21 to 24 is an antenna device configured to transmit or receive a radio wave with a 28-GHz band, for example. The millimeter-wave antenna devices 21 to 24 are, for example, used for communicating with a radio base station configured to transmit or receive a radio wave with the quasi-millimeter wave band or the millimeter wave band in a fifth-generation mobile communication system. Note that the millimeter-wave antenna devices 21, 22, 23, 24 are each specific examples of first, second, third, and fourth millimeter-wave antenna devices.

The millimeter-wave antenna device 21 includes a base connector 31, a module connector 51, and an antenna module 81. The base connector 31 is fixed to the support substrate 14. The module connector 51 is positioned above the base connector 31, and is connected to the base connector 31 to be insertable into or extractable from the base connector 31. The antenna module 81 is fixed to the module connector 51.

The antenna module 81 includes an antenna substrate 82, multiple antenna elements 83, and a radio frequency (RF) circuit 84 as an antenna circuit. As shown in FIG. 1, the antenna substrate 82 is a substantially quadrangular small substrate.

Each antenna element 83 is an element configured to transmit or receive a radio wave with the quasi-millimeter wave band or the millimeter wave band. Each antenna element 83 is provided on a front surface of the antenna substrate 82. For example, on the antenna substrate 82, four of the antenna elements 83 are arrayed in a matrix of 2×2 to form a planar array antenna for transmission, and four of the antenna elements 83 are further arrayed in a matrix of 2×2 to form a planar array antenna for reception. Each of these planar array antennas has such a directivity toward the front of the front surface of the antenna substrate 82 that a radio wave emission intensity or a receiving sensitivity in a direction perpendicular to the front surface of the antenna substrate 82 is highest.

The RF circuit 84 is a circuit configured to perform signal processing relating to transmission or reception of a radio wave with the quasi-millimeter wave band or the millimeter wave band, and is provided on a back surface of the antenna substrate 82. For example, in the RF circuit 84, signal processing for transmitting or receiving signals via the multiple antenna elements 83 is performed using multiple input multiple output (MIMO). Moreover, the RF circuit 84 is connected to the communication apparatus and the power source mounted on the subject vehicle via the module connector 51, the base connector 31, the wires formed on the support substrate 14, the cables connected to these wires or the like. The antenna module 81 frequency-converts, e.g., a transmission signal (a transmission intermediate-frequency signal) output from the communication apparatus mounted on the subject vehicle and having several GHz or several tens of GHz into a signal with the quasi-millimeter wave band or the millimeter wave band, and emits such a signal as a radio wave. Moreover, the antenna module 81 frequency-converts a signal corresponding to a received radio wave and having the quasi-millimeter wave band or the millimeter wave band into, e.g., a reception signal (a reception intermediate-frequency signal) with several GHz or several tens of GHz, and outputs such a signal to the communication apparatus mounted on the subject vehicle. The RF circuit 84 is provided with a frequency converter configured to perform such frequency conversion.

Moreover, the antenna module 81 is fixed to the module connector 51 such that the front surface of the antenna substrate 82 faces up diagonally to the outside of the module connector 51 in a state in which the upper surface 14A of the support substrate 14 is substantially horizontal, the base connector 31 is fixed to the support substrate 14, and the module connector 51 is connected to the base connector 31.

Each of the millimeter-wave antenna devices 22, 23, 24 has the same configuration as that of the millimeter-wave antenna device 21.

On the other hand, each of the non-millimeter-wave antenna devices 121 to 124 is an antenna device configured to transmit or receive a radio wave with a frequency band lower than the quasi-millimeter wave band. For example, the frequency of a radio wave in the millimeter-wave antenna devices 21 to 24 is equal to or higher than 20 GHz, and on the other hand, the frequency of a radio wave in the non-millimeter-wave antenna devices 121 to 124 is lower than 20 GHz. For example, the non-millimeter-wave antenna device 121 is an antenna device configured to perform communication by means of a radio wave with a frequency band (e.g., a 3.7-GHz band or a 4.5-GHz band) lower than the quasi-millimeter wave band in the fifth-generation mobile communication system. The non-millimeter-wave antenna device 122 is an antenna device for GNSS. The non-millimeter-wave antenna device 123 is an antenna device for LTE. The non-millimeter-wave antenna device 124 is an antenna device for V2X. Note that the non-millimeter-wave antenna device 123 is also used for communication using a radio wave with a frequency band lower than the quasi-millimeter wave band in the fifth-generation mobile communication system. Antennas of the non-millimeter-wave antenna devices 121, 123, 124 are each non-directional antennas. An antenna of the non-millimeter-wave antenna device 122 has such a directivity upward of the upper surface 14A of the support substrate 14 that a radio wave emission intensity or a receiving sensitivity in a direction perpendicular to the upper surface 14A is highest. The non-millimeter-wave antenna devices 121 to 124 are connected to the communication apparatus, the power source and the like mounted on the subject vehicle via the wires formed on the support substrate 14, the cables connected to these wires or the like. Note that the non-millimeter-wave antenna devices 121, 122, 123, 124 are each specific examples of first, second, third, and fourth non-millimeter-wave antenna devices.

Figure 2:
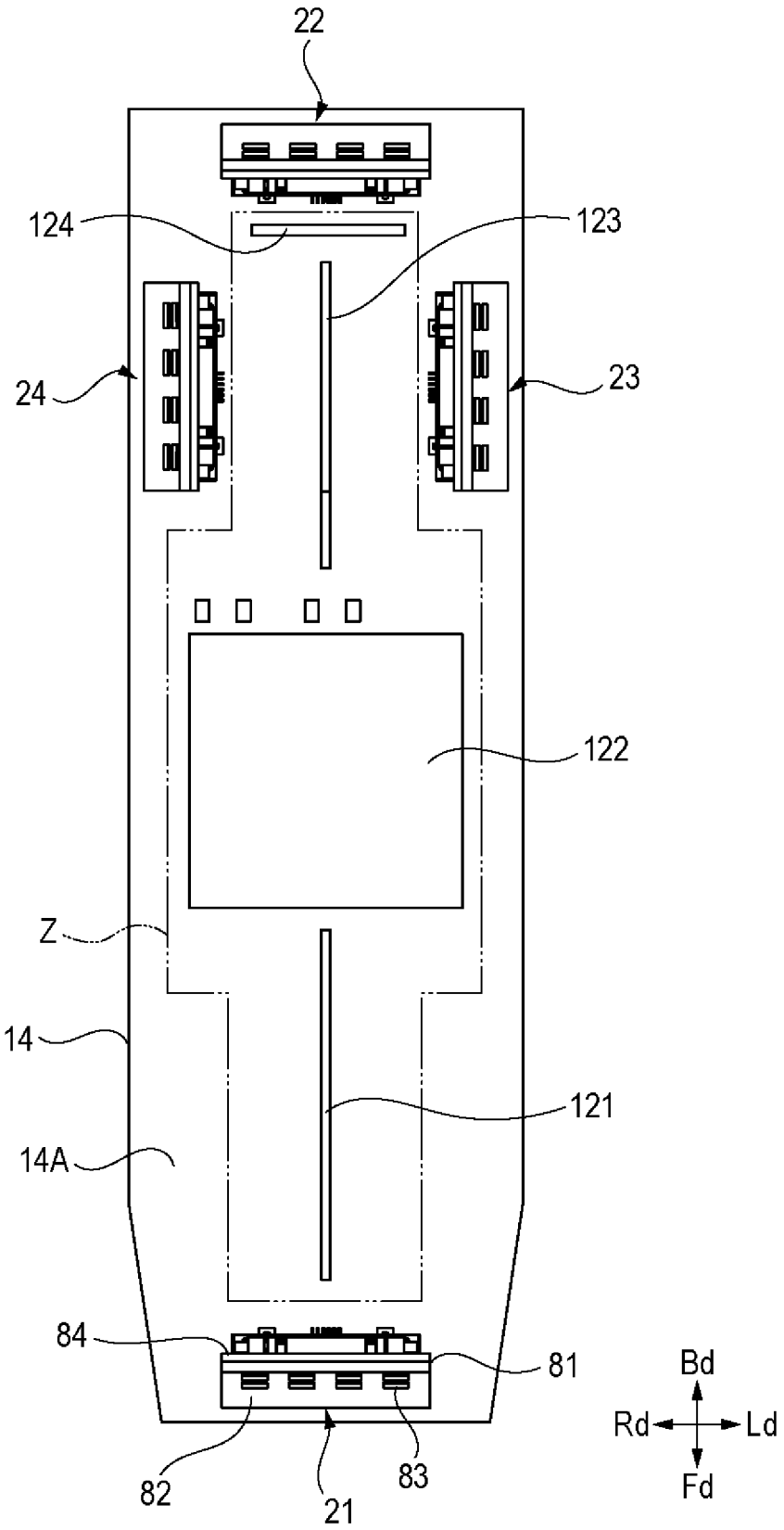
FIG. 2 is a plan view showing a support substrate of FIG. 1 and multiple millimeter-wave antenna devices and multiple non-millimeter-wave antenna devices provided on the support substrate.

FIG. 2 shows, from above, the support substrate 14 to which the millimeter-wave antenna devices 21 to 24 and the non-millimeter-wave antenna devices 121 to 124 are fixed. The non-millimeter-wave antenna devices 121 to 124 are arranged in an inner or center region of the upper surface 14A of the support substrate 14, i.e., a region of the upper surface 14A including the center thereof, specifically a region Z indicated by a chain double-dashed line in FIG. 2. More specifically, the non-millimeter-wave antenna device 121 is arranged at a front portion in the region Z, and the non-millimeter-wave antenna device 122 is arranged at a substantially center portion in the region Z. Moreover, the non-millimeter-wave antenna device 123 is arranged at a back portion in the region Z, and the non-millimeter-wave antenna device 124 is arranged at the back of the non-millimeter-wave antenna device 123 in the region Z. Of the non-millimeter-wave antenna devices 121 to 124, the non-millimeter-wave antenna device 121 is arranged on the frontmost side in the region Z. Of the non-millimeter-wave antenna devices 121 to 124, the non-millimeter-wave antenna device 124 is arranged on the backmost side in the region Z.

On the other hand, the millimeter-wave antenna devices 21 to 24 are arranged in an outer, end, or peripheral edge region of the upper surface 14A of the support substrate 14, specifically a region of the upper surface 14A of the support substrate 14 outside the region Z where the non-millimeter-wave antenna devices 121 to 124 are arranged.

More specifically, the millimeter-wave antenna device 21 is arranged at a front end portion of the upper surface 14A of the support substrate 14 such that the front surface of the antenna substrate 82 faces the upper front side. The millimeter-wave antenna device 22 is arranged at a back end portion of the upper surface 14A of the support substrate 14 such that the front surface of the antenna substrate 82 faces the upper back side. The millimeter-wave antenna device 23 is arranged at a left end portion (an end portion in a direction indicated by the arrow Ld) of the upper surface 14A of the support substrate 14 such that the front surface of the antenna substrate 82 faces the upper left side. The millimeter-wave antenna device 24 is arranged at a right end portion (an end portion in a direction indicated by the arrow Rd) of the upper surface 14A of the support substrate 14 such that the front surface of the antenna substrate 82 faces the upper right side.

The millimeter-wave antenna device 21 is arranged at the front of the non-millimeter-wave antenna device 121, and the millimeter-wave antenna device 22 is arranged at the back of the non-millimeter-wave antenna device 124. The millimeter-wave antenna device 23 is arranged at the left of the non-millimeter-wave antenna device 123, and the millimeter-wave antenna device 24 is arranged at the right of the non-millimeter-wave antenna device 123.

The millimeter-wave antenna device 21 is arranged on the frontmost side among all antenna devices (the millimeter-wave antenna devices 21 to 24 and the non-millimeter-wave antenna devices 121 to 124) arranged on the upper surface 14A of the support substrate 14, and no other components are interposed between the millimeter-wave antenna device 21 and an inner surface of a front portion of the cover 13. The millimeter-wave antenna device 22 is arranged on the backmost side among all antenna devices arranged on the upper surface 14A of the support substrate 14, and no other components are interposed between the millimeter-wave antenna device 22 and an inner surface of a back portion of the cover 13. The millimeter-wave antenna device 23 is arranged on the leftmost side among all antenna devices arranged on the upper surface 14A of the support substrate 14, and no other components are interposed between the millimeter-wave antenna device 23 and an inner surface of a left portion of the cover 13. The millimeter-wave antenna device 24 is arranged on the rightmost side among all antenna devices arranged on the upper surface 14A of the support substrate 14, and no other components are interposed between the millimeter-wave antenna device 24 and an inner surface of a right portion of the cover 13.

According to the antenna apparatus 1 of the embodiment of the present invention, the front surfaces of the antenna substrates 82 of the millimeter-wave antenna devices 21 to 24, i.e., a front surface of each antenna element 83, face four sides (the front, the back, the right, and the left) in the horizontal direction. Thus, a high-intensity radio wave with the quasi-millimeter wave band or the millimeter wave band can be emitted across a broad area around the subject vehicle in the horizontal direction, and the receiving sensitivity of a radio wave with the quasi-millimeter wave band or the millimeter wave band can be enhanced across a broad area around the subject vehicle in the horizontal direction. Thus, favorable communication can be performed using a radio wave with the quasi-millimeter wave band or the millimeter wave band even when the subject vehicle faces any direction in the horizontal direction.

Moreover, according to the antenna apparatus 1 of the embodiment of the present invention, the front surface of the antenna substrate 82 of each of the millimeter-wave antenna devices 21 to 24, i.e., the front surface of each antenna element 83, faces diagonally upward. Thus, a high-intensity radio wave with the quasi-millimeter wave band or the millimeter wave band can be emitted to the radio base station placed at a position higher than the roof of the subject vehicle, such as an upper portion of a building or a pole, and the receiving sensitivity of a radio wave with the quasi-millimeter wave band or the millimeter wave band from the radio base station placed at such a high position can be enhanced. Thus, even in a situation where a propagation loss of a radio wave with the quasi-millimeter wave band or the millimeter wave band is likely to increase, such as raining, high-quality communication can be performed using a radio wave with the quasi-millimeter wave band or the millimeter wave band.

Further, according to the antenna apparatus 1 of the embodiment of the present invention, the millimeter-wave antenna devices 21 to 24 are, on the upper surface 14A of the support substrate 14, arranged in the region outside the region Z where the non-millimeter-wave antenna devices 121 to 124 are arranged, and therefore, a radio wave with the quasi-millimeter wave band or the millimeter wave band from each of the millimeter-wave antenna devices 21 to 24 is not blocked by the non-millimeter-wave antenna device 121, 122, 123, 124. Moreover, a radio wave with the quasi-millimeter wave band or the millimeter wave band from the radio base station to the millimeter-wave antenna device 21, 22, 23, 24 is not blocked by the non-millimeter-wave antenna device 121, 122, 123, 124. Thus, favorable communication can be performed using a radio wave with the quasi-millimeter wave band or the millimeter wave band.

In addition, according to the antenna apparatus 1 of the embodiment of the present invention, no other components are interposed between the millimeter-wave antenna device 21 and the inner surface of the front portion of the cover 13, no other components are interposed between the millimeter-wave antenna device 22 and the inner surface of the back portion of the cover 13, no other components are interposed between the millimeter-wave antenna device 23 and the inner surface of the left portion of the cover 13, and no other components are interposed between the millimeter-wave antenna device 24 and the inner surface of the right portion of the cover 13. Thus, favorable communication can be performed using a radio wave with the quasi-millimeter wave band or the millimeter wave band.

(Millimeter-Wave Antenna Device)

The millimeter-wave antenna devices 21 to 24 will be further described. Note that the millimeter-wave antenna devices 21 to 24 have the same configuration, and therefore, only the millimeter-wave antenna device 21 will be described. Moreover, the antenna module 81 has been already sufficiently described, and therefore, the base connector 31 and the module connector 51 of the millimeter-wave antenna device 21 will be described below.

Figure 3:
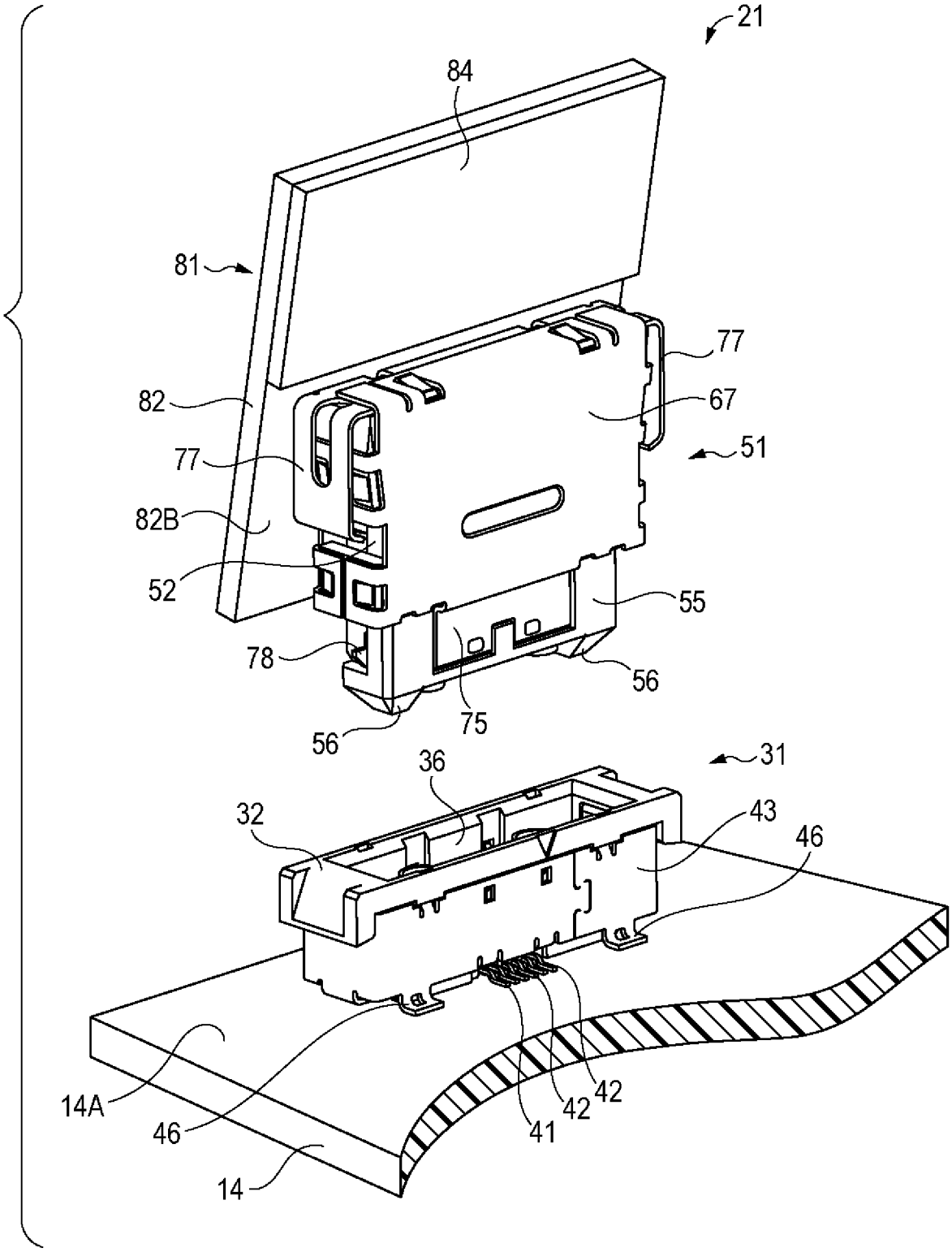
FIG. 3 is a perspective view showing the millimeter-wave antenna device of the embodiment of the present invention in a state in which a base connector and a module connector are separated from each other.
Figure 4:
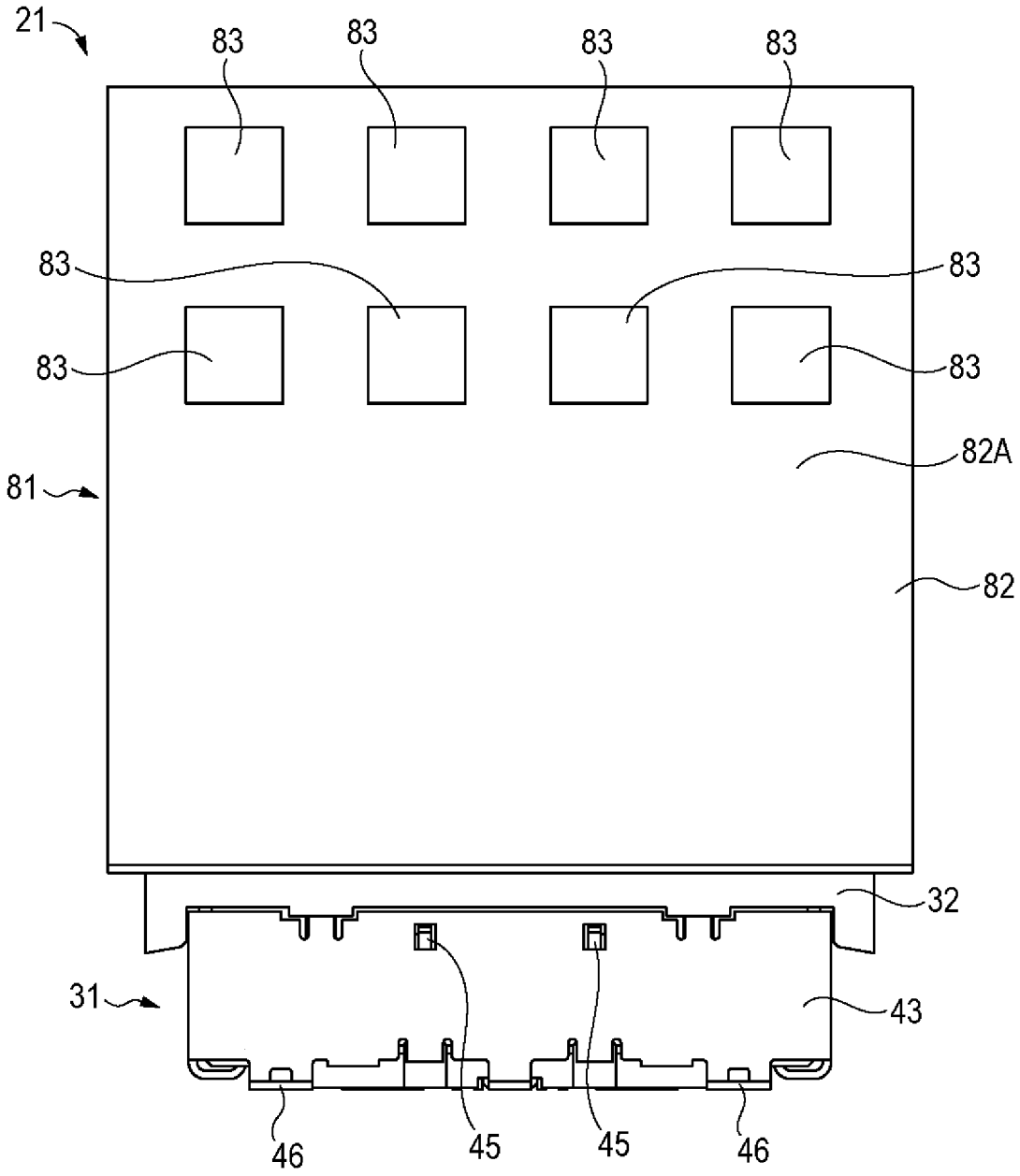
FIG. 4 is a front view showing the millimeter-wave antenna device of the embodiment of the present invention.
Figure 5:
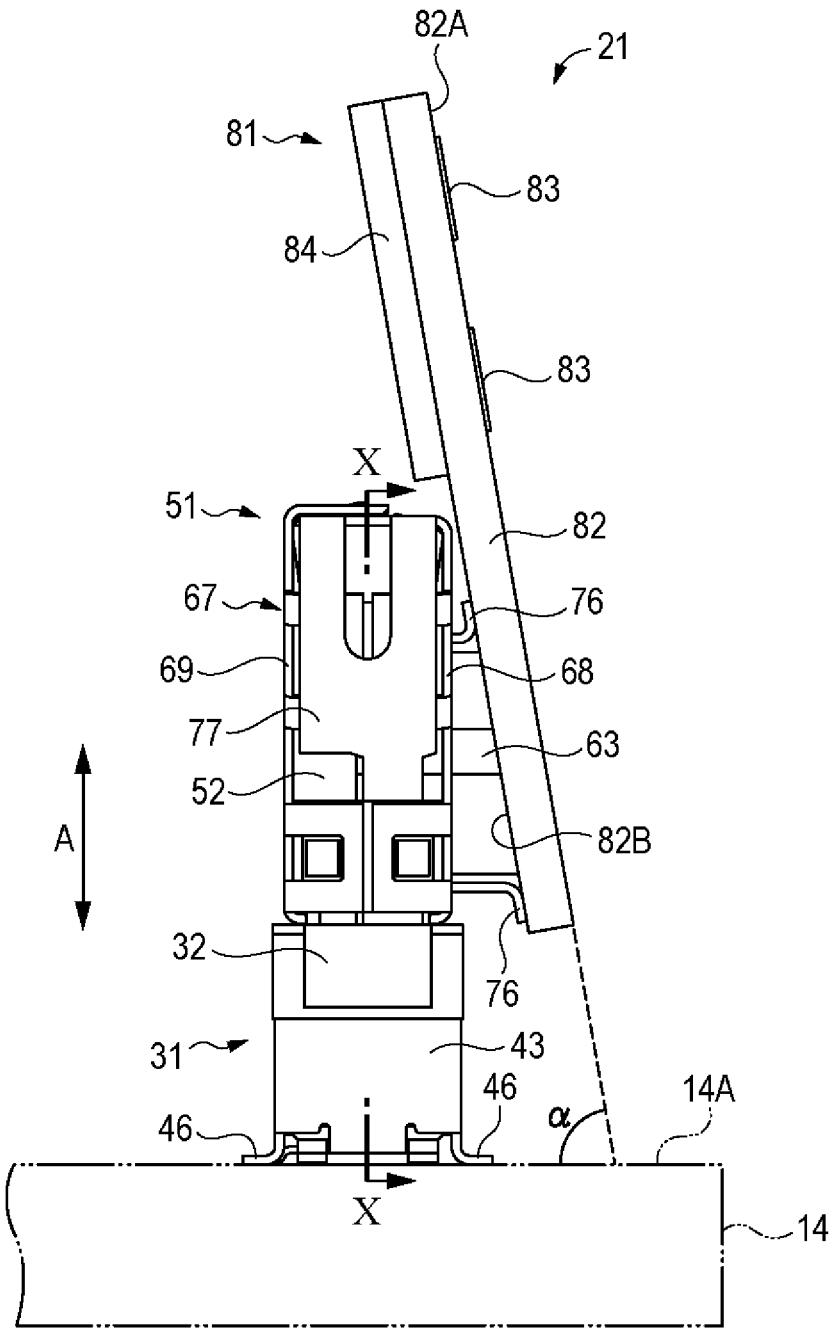
FIG. 5 is a side view showing the millimeter-wave antenna device of the embodiment of the present invention.
Figure 6:
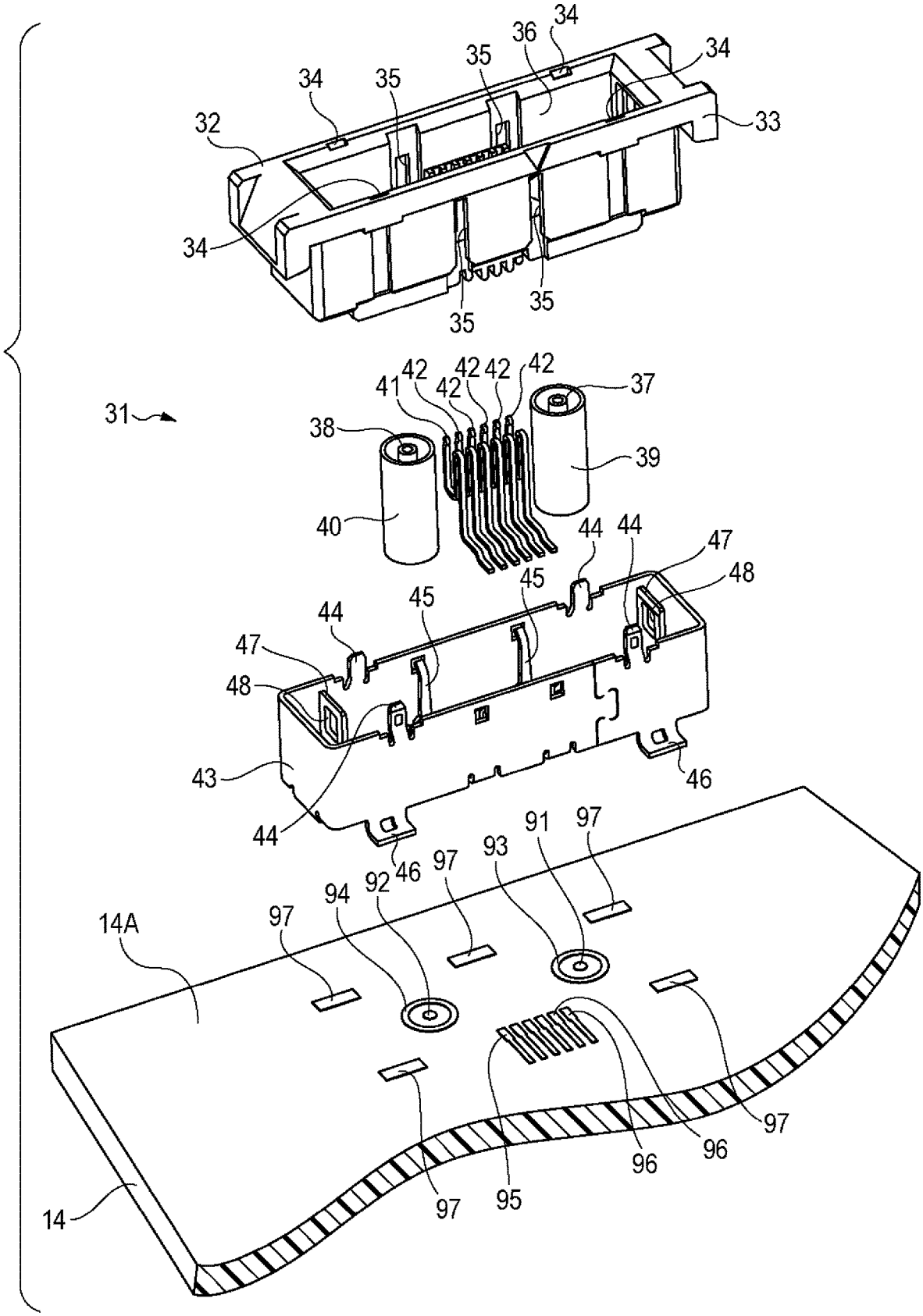
FIG. 6 is an exploded perspective view showing the base connector of the millimeter-wave antenna device and the support substrate of the embodiment of the present invention.
Figure 7:
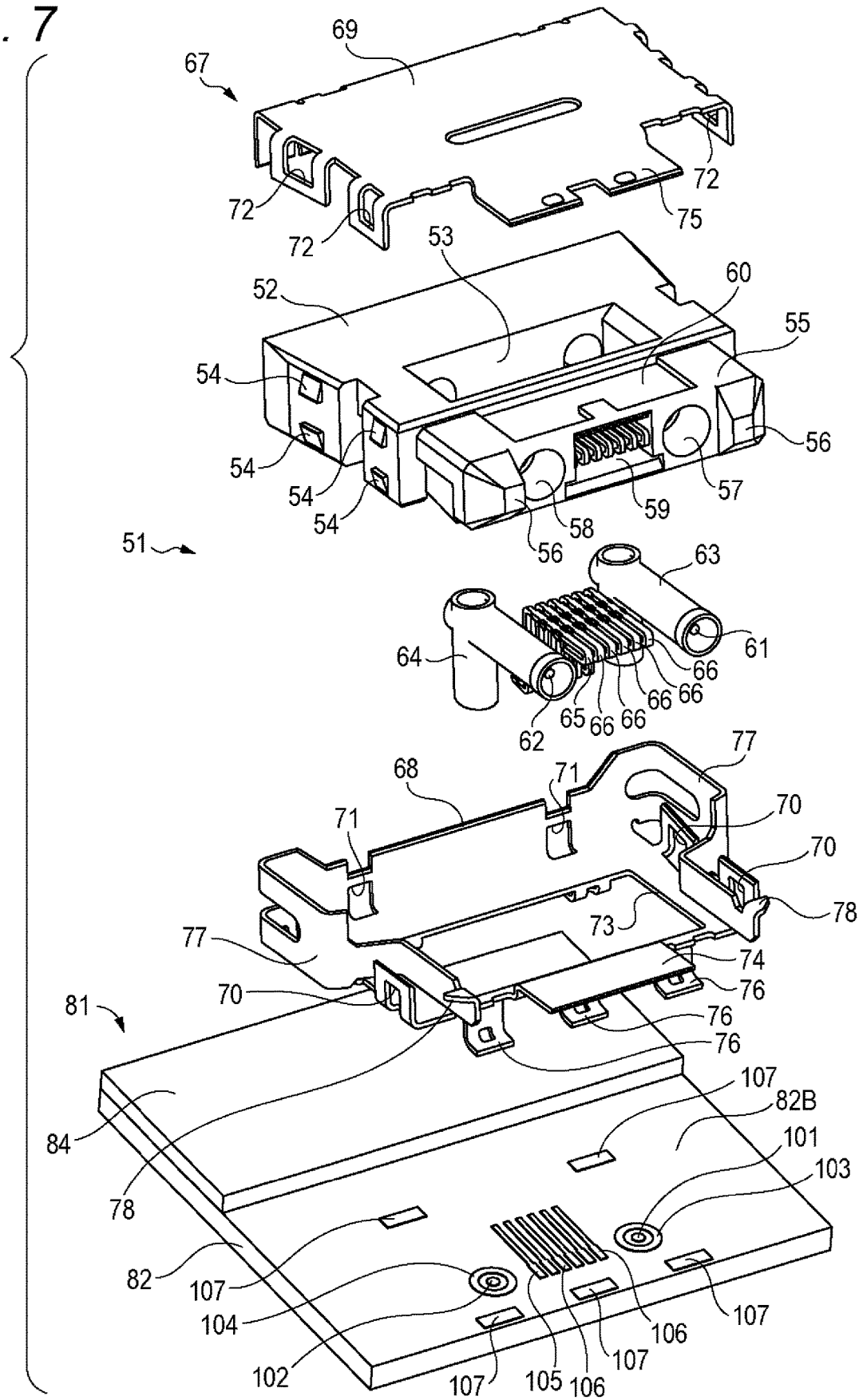
FIG. 7 is an exploded perspective view showing the module connector and an antenna module of the millimeter-wave antenna device of the embodiment of the present invention.
Figure 8:
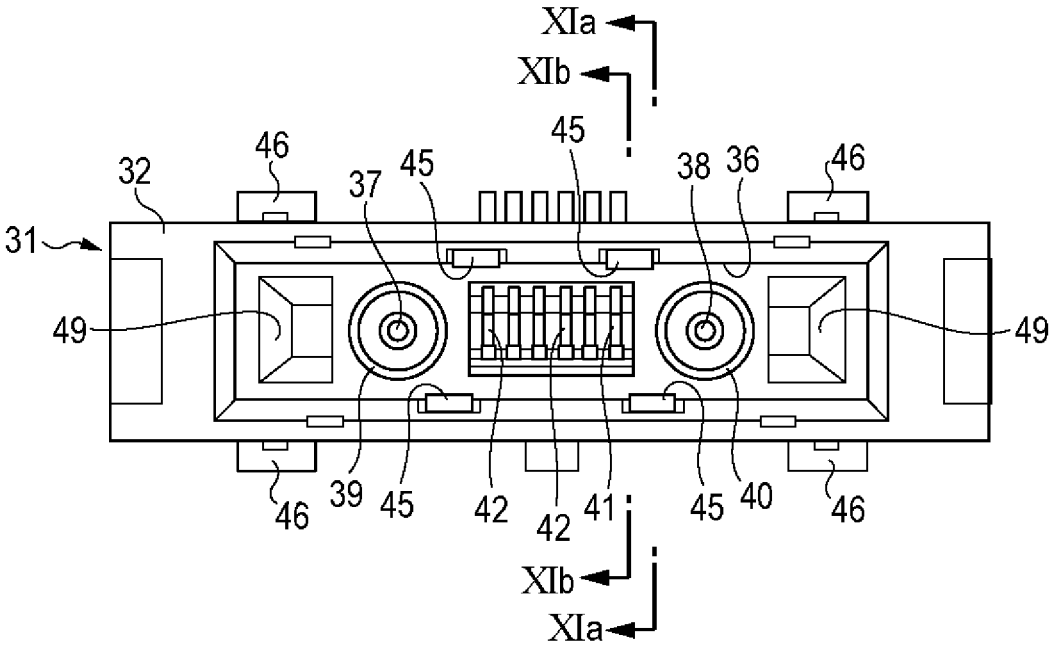
FIG. 8 is a plan view showing the base connector of the millimeter-wave antenna device of the embodiment of the present invention.
Figure 9:
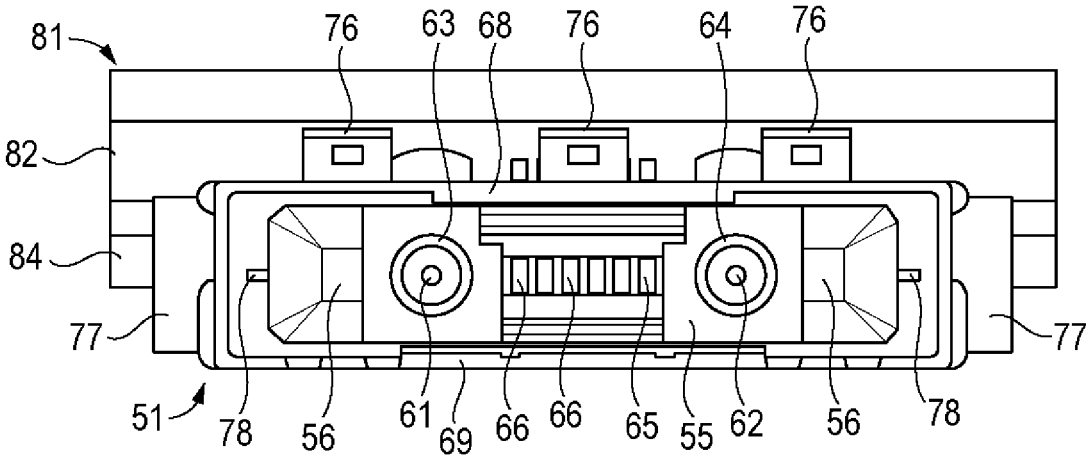
FIG. 9 is a bottom view showing the module connector and the antenna module of the millimeter-wave antenna device of the embodiment of the present invention.
Figure 10:
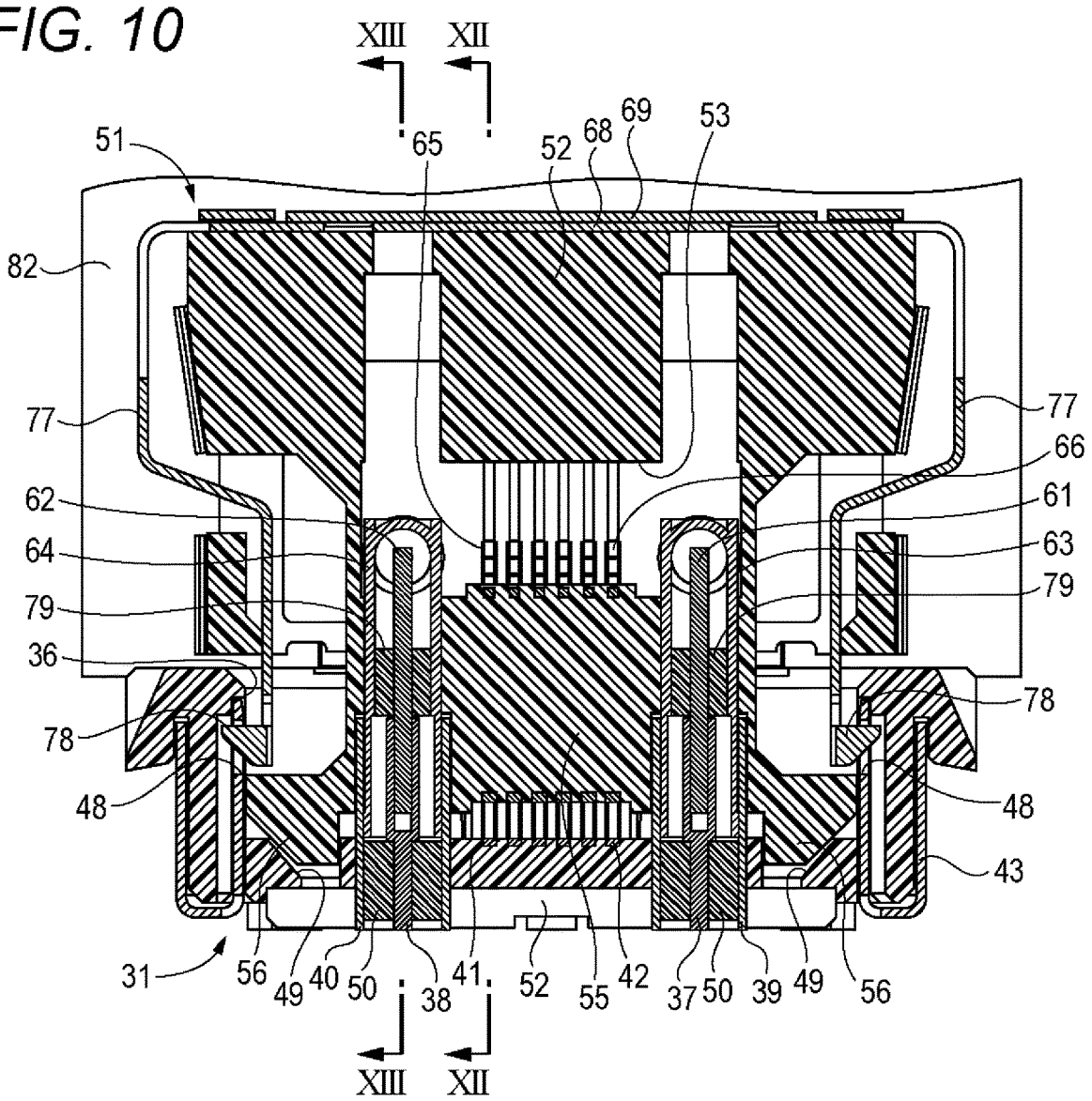
FIG. 10 is a sectional view showing a state in which the section of the millimeter-wave antenna device of FIG. 5 along a cut line X-X is viewed from the left side in FIG. 5.
Figure 11A:
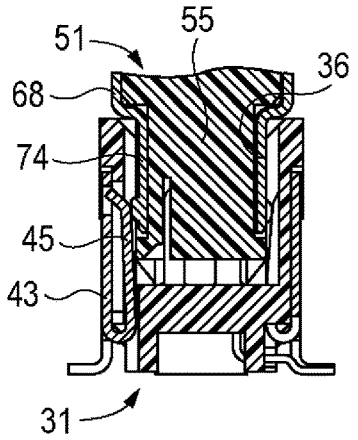
FIG. 11A is a sectional view showing a state in which the section of a fitting portion between the base connector and the module connector, which are fitted to each other, along a cut line XIa-XIa in FIG. 8 is viewed from the right side in FIG. 8.
Figure 11B:
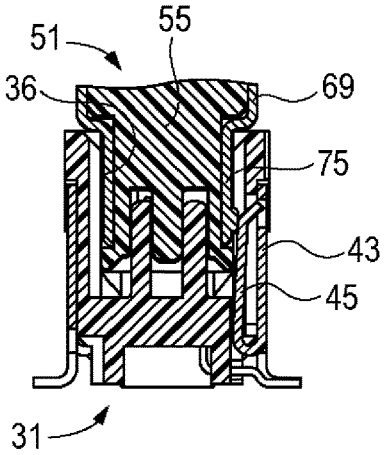
FIG. 11B is a sectional view showing a state in which the section of the fitting portion between the base connector and the module connector, which are fitted to each other, along a cut line XIb-XIb in FIG. 8 is viewed from the right side in FIG. 8.
Figure 12:
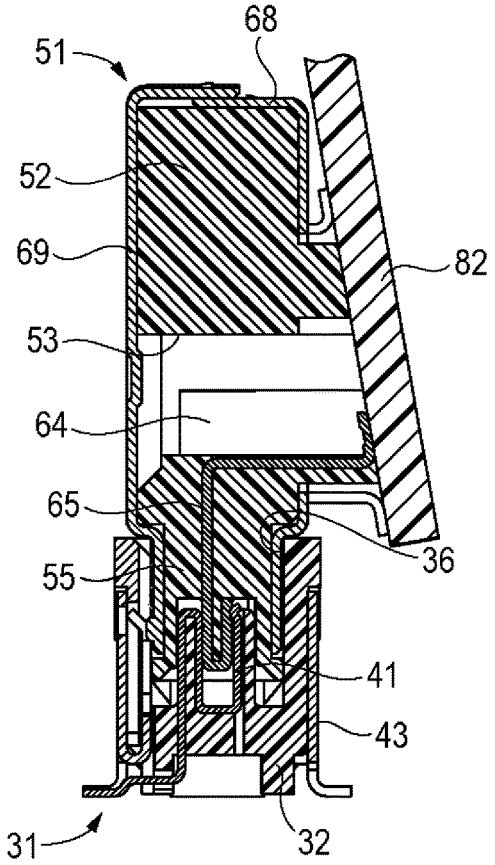
FIG. 12 is a sectional view showing a state in which the section of the millimeter-wave antenna device of FIG. 10 along a cut line XII-XII is viewed from the right side in FIG. 10.
Figure 13:
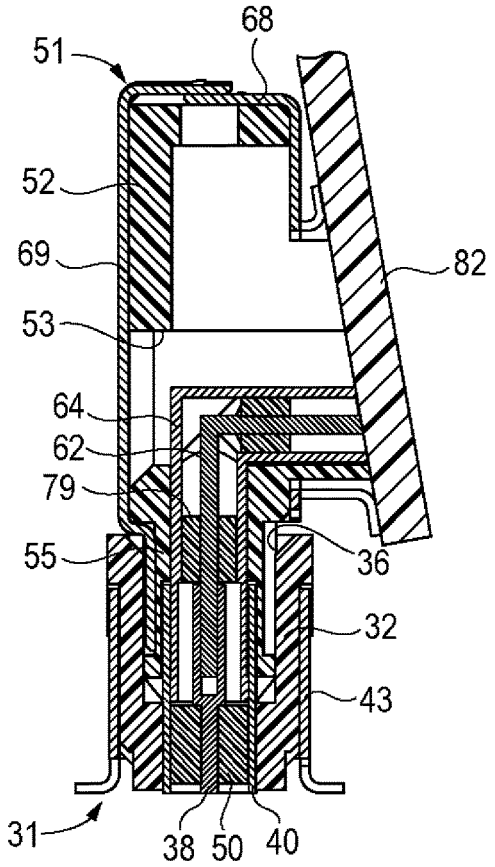
FIG. 13 is a sectional view showing a state in which the section of the millimeter-wave antenna device of FIG. 10 along a cut line XIII-XIII is viewed from the right side in FIG. 10.

FIG. 3 shows the millimeter-wave antenna device 21 in a state in which the base connector 31 and the module connector 51 are separated from each other. FIG. 4 is a front view of the millimeter-wave antenna device 21. FIG. 5 is a side view of the millimeter-wave antenna device 21. FIG. 6 is an exploded perspective view of the base connector 31 and the support substrate 14. FIG. 7 is an exploded perspective view of the module connector 51 and the antenna module 81. FIG. 8 is a plan view of the base connector 31. FIG. 9 is a bottom view of the module connector 51. FIG. 10 is a sectional view showing a state in which the section of the millimeter-wave antenna device 21 of FIG. 5 along a cut line X-X is viewed from the left side in FIG. 5. FIG. 11A is a sectional view showing a state in which the section of a fitting portion between the base connector 31 and the module connector 51, which are fitted to each other, along a cut line XIa-XIa of FIG. 8 is viewed from the right side in FIG. 8. FIG. 11B is a sectional view showing a state in which the section of the fitting portion between the base connector 31 and the module connector 51, which are fitted to each other, along a cut line XIb-XIb of FIG. 8 is viewed from the right side in FIG. 8. FIG. 12 is a sectional view showing a state in which the section of the millimeter-wave antenna device 21 of FIG. 10 along a cut line XII-XII is viewed from the right side in FIG. 10. FIG. 13 is a sectional view showing the section of the millimeter-wave antenna device 21 of FIG. 10 along a cut line XIII-XIII is viewed from the right side in FIG. 10.

As shown in FIGS. 3 to 5, the millimeter-wave antenna device 21 includes the base connector 31 fixed to the support substrate 14, the module connector 51 connected to the base connector 31 to be insertable into or extractable from the base connector 31, and the antenna module 81 fixed to the module connector 51 and configured to transmit or receive a radio wave with the quasi-millimeter wave band or the millimeter wave band.

As shown in FIG. 6, the base connector 31 includes a casing 32, a fitting portion 36, a transmission terminal 37, a reception terminal 38, two separate shield members 39, 40, a power supply terminal 41, multiple other terminals 42, and an overall shield member 43.

The casing 32 is formed in a substantially tubular shape having a rectangular cross-sectional shape from an insulating material such as resin. The fitting portion 36 is formed on the upper end side of the casing 32. That is, an upper opening of the casing 32 serves as the fitting portion 36. The fitting portion 36 is to be fitted onto a fitting portion 55 of the module connector 51. Moreover, the fitting portion 36 is formed such that an insertion/extraction direction A (see FIG. 5) of the module connector 51 with respect to the base connector 31 is perpendicular to the upper surface 14A of the support substrate 14.

Each of the transmission terminal 37, the reception terminal 38, the separate shield members 39, 40, the power supply terminal 41, and the multiple other terminals 42 is made of a conductive material such as metal, and is arranged in the casing 32.

The transmission terminal 37 is a terminal for transferring the transmission signal (the transmission intermediate-frequency signal) from the communication apparatus mounted on the subject vehicle to the RF circuit 84 of the antenna module 81. The reception terminal 38 is a terminal for transferring the reception signal (the reception intermediate-frequency signal) from the RF circuit 84 of the antenna module 81 to the communication apparatus mounted on the subject vehicle. Each of the transmission terminal 37 and the reception terminal 38 is formed in a cylindrical shape extendable in an up-down direction. The lower end side of the transmission terminal 37 is, by, e.g., reflow soldering, connected to a pad 91 formed on the upper surface 14A of the support substrate 14. The lower end side of the reception terminal 38 is, by, e.g., reflow soldering, connected to a pad 92 formed on the upper surface 14A of the support substrate 14. The pads 91, 92 are connected to the communication apparatus mounted on the subject vehicle via the wires formed on the support substrate 14, the cables connected to these wires or the like. As shown in FIG. 10 or 13, when the fitting portion 55 of the module connector 51 is fitted in the fitting portion 36 of the base connector 31, the upper end side of the transmission terminal 37 contacts a transmission terminal 61 of the module connector 51, and the upper end side of the reception terminal 38 contacts a reception terminal 62 of the module connector 51.

The separate shield member 39 is a member configured to separately electromagnetically shield the transmission terminal 37. Moreover, the separate shield member 39 has the function of making impedance matching between transmission signal transfer paths between the base connector 31 and the support substrate 14 and between the base connector 31 and the module connector 51. The separate shield member 40 is a member configured to separately electromagnetically shield the reception terminal 38. Moreover, the separate shield member 40 has the function of making impedance matching between reception signal transfer paths between the base connector 31 and the support substrate 14 and between the base connector 31 and the module connector 51. As shown in FIG. 6, each of these separate shield members 39, 40 is formed in a cylindrical shape extendable in the up-down direction. The separate shield member 39 surrounds the outer peripheral side of the transmission terminal 37. The transmission terminal 37 and the separate shield member 39 are arranged coaxially. The separate shield member 40 surrounds the outer peripheral side of the reception terminal 38. The reception terminal 38 and the separate shield member 40 are arranged coaxially. As shown in FIG. 10, insulating members 50 are each provided between the transmission terminal 37 and the separate shield member 39 and between the reception terminal 38 and the separate shield member 40. As shown in FIG. 6, the lower end sides of the separate shield members 39, 40 are, by, e.g., reflow soldering, each connected to pads 93, 94 formed on the upper surface 14A of the support substrate 14. The pads 93, 94 are connected to a ground line, for example. As shown in FIG. 10 or 13, when the fitting portion 55 of the module connector 51 is fitted in the fitting portion 36 of the base connector 31, the separate shield members 39, 40 each contact separate shield members 63, 64 of the module connector 51.

The power supply terminal 41 is a terminal for supplying power from the power source mounted on the subject vehicle to the RF circuit 84 of the antenna module 81. The power supply terminal 41 is formed in such a manner that a linear conductive material is bent in a shape shown in FIG. 12. As shown in FIG. 6, the lower end side of the power supply terminal 41 is, by, e.g., reflow soldering, connected to a pad 95 formed on the upper surface 14A of the support substrate 14. The pad 95 is connected to the power source mounted on the subject vehicle via the wires formed on the support substrate 14, the cables connected to these wires or the like. As shown in FIG. 12, when the fitting portion 55 of the module connector 51 is fitted in the fitting portion 36 of the base connector 31, the upper end side of the power supply terminal 41 contacts a power supply terminal 65 of the module connector 51.

The multiple other terminals 42 are terminals for transferring a clock signal, a control signal or the like to the RF circuit 84, for example. Each of the multiple other terminals 42 is formed in a manner similar to that of the power supply terminal 41. As shown in FIG. 6, the lower end sides of the multiple other terminals 42 are, by, e.g., reflow soldering, each connected to multiple pads 96 formed on the upper surface 14A of the support substrate 14. The multiple pads 96 are connected to the communication apparatus mounted on the subject vehicle via the wires formed on the support substrate 14, the cables connected to these wires or the like. When the fitting portion 55 of the module connector 51 is fitted in the fitting portion 36 of the base connector 31, the upper end side of each of the other terminals 42 contacts a corresponding one of other terminals 66 of the module connector 51.

As shown in FIG. 8, when the base connector 31 is viewed from above, the reception terminal 38 and the transmission terminal 37 are each arranged on the right and left sides in the casing 32 (in the fitting portion 36). The power supply terminal 41 and the multiple other terminals 42 are arranged between the transmission terminal 37 and the reception terminal 38, and are positioned at the center in the casing 32 (in the fitting portion 36).

The overall shield member 43 is a member configured to collectively cover the transmission terminal 37, the reception terminal 38, the separate shield members 39, 40, the power supply terminal 41, and the multiple other terminals 42 to entirely electromagnetically shield these terminals and members. The overall shield member 43 is made of a conductive material such as metal, and surrounds the outer peripheral side of the casing 32.

As shown in FIG. 6, four attachment pieces 44 protruding upward are provided on the upper end side of the overall shield member 43, and a locking protrusion is formed at each attachment piece 44. A flange portion 33 projecting outward is formed across the entire circumference of the upper end side of a peripheral wall of the casing 32, and attachment holes 34 are provided at four locations of the flange portion 33. The overall shield member 43 is fixed to the casing 32 in such a manner that the four attachment pieces 44 are each inserted into the four attachment holes 34 and each attachment piece 44 is locked in a corresponding one of the attachment holes 34.

Four shield contact pieces 45 are also provided at the overall shield member 43. Connection piece insertion holes 35 are formed at four locations of the casing 32. As shown in FIG. 8, the four shield contact pieces 45 each pass through the four connection piece insertion holes 35, and project into the fitting portion 36 from the outside of the casing 32. As shown in FIG. 11A, two of the shield contact pieces 45 arranged on the front side of the overall shield member 43 extend upward after having projected to the back side from a lower portion of a wall plate on the front side of the overall shield member 43. As shown in FIG. 11B, two of the shield contact pieces 45 arranged on the back side of the overall shield member 43 extend upward after having projected to the front side from a lower portion of a wall plate on the back side of the overall shield member 43. When the fitting portion 55 of the module connector 51 is fitted in the fitting portion 36 of the base connector 31, the four shield contact pieces 45 projecting into the fitting portion 36 contact shield connection pieces 74, 75 of the module connector 51.

As can be grasped from FIGS. 4 to 6, four fixing portions 46 for fixing the casing 32 and the overall shield member 43 to the support substrate 14 are provided on the lower end side of the overall shield member 43. Each fixing portion 46 is, by, e.g., reflow soldering, connected to a pad 97 formed on the upper surface 14A of the support substrate 14.

As shown in FIG. 6, locking pieces 47 are each provided at right and left portions of the overall shield member 43, and a locking hole 48 is provided at each locking piece 47. As shown in FIG. 10, when the fitting portion 55 of the module connector 51 is fitted in the fitting portion 36 of the base connector 31, locking protrusions 78 at the right and left of the module connector 51 are each locked in the locking holes 48 of the locking pieces 47 at the right and left of the overall shield member 43, and the module connector 51 is locked to the base connector 31.

Note that the casing 32 is a specific example of a base-side casing. The fitting portion 36 is a specific example of a base-side fitting portion. The transmission terminal 37, the reception terminal 38, the power supply terminal 41, and the other terminals 42 are specific examples of a base-side terminal. The transmission terminal 37 is a specific example of a base-side transmission terminal. The reception terminal 38 is a specific example of a base-side reception terminal. The separate shield member 39 is a specific example of a first base-side separate shield member. The separate shield member 40 is a specific example of a second base-side separate shield member. The power supply terminal 41 is a specific example of a base-side power supply terminal. The overall shield member 43 is a specific example of a base-side overall shield member. The pads 91 to 97 formed on the upper surface 14A of the support substrate 14 and the wires formed on the support substrate 14 are specific examples of a substrate-side circuit.

As shown in FIG. 7, the module connector 51 includes a casing 52, the fitting portion 55, the transmission terminal 61, the reception terminal 62, the two separate shield members 63, 64, the power supply terminal 65, the multiple other terminals 66, and an overall shield member 67.

The casing 52 is formed in a substantially rectangular parallelepiped shape from an insulating material such as resin. A terminal housing portion 53 is formed at a center portion of the casing 52. The fitting portion 55 protrudes downward of the lower end side of the casing 52. The fitting portion 55 is inserted into the fitting portion 36 of the base connector 31, and is fitted in the fitting portion 36. Raised portions 56 protruding downward are each formed at right and left portions of a lower end surface of the fitting portion 55. As shown in FIG. 10, when the fitting portion 55 is inserted into the fitting portion 36 of the base connector 31, these two raised portions 56 are inserted into recessed portions 49 each formed at right and left portions of a bottom portion of the fitting portion 36. With this configuration, the position of the fitting portion 55 in the fitting portion 36 is determined with a high accuracy.

Each of the transmission terminal 61, the reception terminal 62, the separate shield members 63, 64, the power supply terminal 65, and the multiple other terminals 66 is made of a conductive material such as metal, and is arranged in the terminal housing portion 53 of the casing 52. As shown in FIG. 7, the lower end side of each of the transmission terminal 61, the reception terminal 62, the separate shield members 63, 64, the power supply terminal 65, and the multiple other terminals 66 is inserted into a corresponding one of terminal insertion holes 57, 58, 59 formed at the fitting portion 55. As shown in FIGS. 9 to 13, each terminal insertion hole 57, 58, 59 penetrates the fitting portion 55 in the up-down direction, and communicates with the terminal housing portion 53.

The transmission terminal 61 is a terminal for transferring the transmission signal (the transmission intermediate-frequency signal) from the communication apparatus mounted on the subject vehicle to the RF circuit 84 of the antenna module 81. The reception terminal 62 is a terminal for transferring the reception signal (the reception intermediate-frequency signal) from the RF circuit 84 of the antenna module 81 to the communication apparatus mounted on the subject vehicle. As shown in FIGS. 7 and 13, each of the transmission terminal 61 and the reception terminal 62 is formed in an L-shape in such a manner that a rod-shaped conductive material is bent. The upper end side of the transmission terminal 61 is, by, e.g., reflow soldering, connected to a pad 101 formed on a back surface 82B of the antenna substrate 82. The upper end side of the reception terminal 62 is, by, e.g., reflow soldering, connected to a pad 102 formed on the back surface 82B of the antenna substrate 82. The pads 101, 102 are connected to the RF circuit 84 via wires formed on the antenna substrate 82. As shown in FIGS. 10 and 13, when the fitting portion 55 of the module connector 51 is fitted in the fitting portion 36 of the base connector 31, the lower end side of the transmission terminal 61 contacts the transmission terminal 37 of the base connector 31, and the lower end side of the reception terminal 62 contacts the reception terminal 38 of the base connector 31.

The separate shield member 63 is a member configured to separately electromagnetically shield the transmission terminal 61. Moreover, the separate shield member 63 has the function of making impedance matching between transmission signal transfer paths between the module connector 51 and the base connector 31 and between the module connector 51 and the RF circuit 84. The separate shield member 64 is a member configured to separately electromagnetically shield the reception terminal 62. Moreover, the separate shield member 64 has the function of making impedance matching between reception signal transfer paths between the module connector 51 and the base connector 31 and between the module connector 51 and the RF circuit 84. Each of these separate shield members 63, 64 is formed in a cylindrical shape extendable in the up-down direction. The separate shield member 63 surrounds the outer peripheral side of the transmission terminal 61. The transmission terminal 61 and the separate shield member 63 are arranged coaxially. The separate shield member 64 surrounds the outer peripheral side of the reception terminal 62. The reception terminal 62 and the separate shield member 64 are arranged coaxially. As shown in FIG. 10, insulating members 79 are each provided between the transmission terminal 61 and the separate shield member 63 and between the reception terminal 62 and the separate shield member 64. As shown in FIG. 7, the lower end sides of the separate shield members 63, 64 are, by, e.g., reflow soldering, each connected to pads 103, 104 formed on the back surface 82B of the antenna substrate 82. The pads 103, 104 are connected to the ground line, for example. As shown in FIGS. 10 and 13, when the fitting portion 55 of the module connector 51 is fitted in the fitting portion 36 of the base connector 31, the separate shield members 63, 64 each contact the separate shield members 39, 40 of the base connector 31.

The power supply terminal 65 is a terminal for supplying power from the power source mounted on the subject vehicle to the RF circuit 84 of the antenna module 81. The power supply terminal 65 is formed in such a manner that a linear conductive material is bent in a shape shown in FIG. 12. As shown in FIG. 7, the upper end side of the power supply terminal 65 is, by, e.g., reflow soldering, connected to a pad 105 formed on the back surface 82B of the antenna substrate 82. The pad 105 is connected to the RF circuit 84 via the wires formed on the antenna substrate 82. As shown in FIG. 12, when the fitting portion 55 of the module connector 51 is fitted in the fitting portion 36 of the base connector 31, the lower end side of the power supply terminal 65 contacts the power supply terminal 41 of the base connector 31.

The multiple other terminals 66 are terminals for transferring a clock signal, a control signal or the like to the RF circuit 84, for example. Each of the multiple other terminals 66 is formed in a manner similar to that of the power supply terminal 65. The upper end sides of the multiple other terminals 66 are, by, e.g., reflow soldering, each connected to multiple pads 106 formed on the back surface 82B of the antenna substrate 82. The multiple pads 106 are connected to the RF circuit 84 via the wires formed on the antenna substrate 82. When the fitting portion 55 of the module connector 51 is fitted in the fitting portion 36 of the base connector 31, the lower end side of each of the other terminals 66 contacts a corresponding one of the other terminals 42 of the base connector 31.

As shown in FIG. 9, when the module connector 51 is viewed from below, the transmission terminal 61, the reception terminal 62, the power supply terminal 65, and the multiple other terminals 66 are arranged corresponding to the transmission terminal 37, the reception terminal 38, the power supply terminal 41, and the other terminals 42 of the base connector 31.

The overall shield member 67 is a member configured to collectively cover the transmission terminal 61, the reception terminal 62, the separate shield members 63, 64, the power supply terminal 65, and the multiple other terminals 66 to entirely electromagnetically shield these terminals and members. As shown in FIG. 7, the overall shield member 67 has two shield plates 68, 69 made of a conductive material such as metal. One shield plate 68 is attached to the front side of the casing 52, and the other shield plate 69 is attached to the back side of the casing 52. With this configuration, the upper and outer peripheral sides of the casing 52 are surrounded by the shield plates 68, 69.

Multiple attachment pieces having attachment holes 70 are provided at right and left portions of one shield plate 68, and attachment holes 71 are provided at an upper portion of one shield plate 68. Multiple attachment pieces having attachment holes 72 are provided at right and left portions of the other shield plate 69, and attachment holes are provided at an upper portion of the other shield plate 69. Multiple attachment protrusions 54 are provided at right, left, and upper surfaces of the casing 52. The shield plates 68, 69 are fixed to the casing 52 in such a manner that the multiple attachment protrusions 54 are each locked in the multiple attachment holes 70, 71, 72. At the shield plate 68 attached to the front side of the casing 52, a through-hole 73 allowing penetration of the upper end sides of the transmission terminal 61, the reception terminal 62, the power supply terminal 65, and the other terminals 66 is formed.

The shield connection piece 74 extending downward while bending in a crank shape in a direction approaching the casing 52 is provided at one shield plate 68. The similar shield connection piece 75 is also provided at the other shield plate 69. At an outer surface of the fitting portion 55 on the front side thereof, a connection piece attachment portion 60 as a recess for attaching the shield connection piece 74 of the shield plate 68 is formed. At an outer surface of the fitting portion 55 on the back side thereof, a connection piece attachment portion 60 as a recess for attaching the shield connection piece 75 of the shield plate 69 is formed. When the shield plates 68, 69 are attached to the casing 52, the shield connection pieces 74, 75 are attached into the connection piece attachment portions 60 each formed on the front and back sides of the fitting portion 55. As shown in FIGS. 11A and 11B, when the fitting portion 55 of the module connector 51 is fitted in the fitting portion 36 of the base connector 31, the shield contact pieces 45 provided at the overall shield member 43 of the base connector 31 contact the shield connection pieces 74, 75 provided at the overall shield member 67 of the module connector 51. With this configuration, the overall shield member 43 of the base connector 31 and the overall shield member 67 of the module connector 51 are electrically connected to each other.

At the shield plate 68 attached to the front side of the casing 52, multiple fixing portions 76 for fixing the antenna module 81 to the module connector 51 are provided. For example, as can be grasped from FIGS. 5 and 7, five fixing portions 76 are provided at the shield plate 68, and are each arranged at an upper right portion, an upper left portion, a lower right portion, a lower left portion, and a lower center portion of the shield plate 68. Each fixing portion 76 is, by, e.g., reflow soldering, connected to a pad 107 formed on the back surface 82B of the antenna substrate 82. As shown in FIG. 5, three of the fixing portions 76 arranged at the lower right portion, the lower left portion, and the lower center portion of the shield plate 68 greatly protrude to the front side (the front) as compared to two of the fixing portions 76 arranged at the upper right portion and the upper left portion of the shield plate 68. The back surface 82B of the antenna substrate 82 is fixed to protruding end portions of these multiple fixing portions 76, and accordingly, the antenna module 81 is fixed to the casing 52 via the shield plate 68 such that the front surface 82A of the antenna substrate 82 faces up diagonally to the outside of the module connector 51. As shown in FIG. 5, the antenna module 81 is preferably fixed to the casing 52 of the module connector 51 such that the angle α of the front surface of the antenna substrate 82 with respect to the upper surface 14A of the support substrate 14 is equal to or higher than 45 degrees and equal to or lower than 90 degrees.

As shown in FIG. 7, spring portions 77 are each provided at the right and left portions of the shield plate 68 attached to the front side of the casing 52. The spring portion 77 provided at the left portion of the shield plate 68 is, at an upper end portion thereof, connected to the upper left portion of the shield plate 68, and is a free end at a lower end portion. Such a spring portion 77 is a plate spring elastically deformable such that a lower end portion thereof displaces in a right-left direction. At the lower end portion of the spring portion 77 provided at the left portion of the shield plate 68, the locking protrusion 78 protruding from the lower end portion of the spring portion 77 to the left is formed. The spring portion 77 provided at the right portion of the shield plate 68 is formed horizontally symmetrical to the spring portion 77 provided at the left portion of the shield plate 68, and is a plate spring elastically deformable such that a lower end portion thereof displaces in the right-left direction. At the lower end portion of the spring portion 77 provided at the right portion of the shield plate 68, the locking protrusion 78 protruding from the lower end portion of the spring portion 77 to the right is formed. As shown in FIG. 10, when the fitting portion 55 of the module connector 51 is fitted in the fitting portion 36 of the base connector 31, the right and left locking protrusions 78 of the shield plate 68 are each locked in the locking holes 48 of the right and left locking pieces 47 of the overall shield member 43, and the module connector 51 is locked to the base connector 31.

Note that the casing 52 is a specific example of a module-side casing. The fitting portion 55 is a specific example of a module-side fitting portion. The transmission terminal 61, the reception terminal 62, the power supply terminal 65, and the other terminals 66 are specific examples of a module-side terminal. The transmission terminal 61 is a specific example of a module-side transmission terminal. The reception terminal 62 is a specific example of a module-side reception terminal. The separate shield member 63 is a specific example of a first module-side separate shield member. The separate shield member 64 is a specific example of a second module-side separate shield member. The power supply terminal 65 is a specific example of a module-side power supply terminal. The overall shield member 67 is a specific example of a module-side overall shield member. The spring portions 77 and the locking protrusions 78 of the module connector 51 and the locking pieces 47 and the locking holes 48 of the base connector 31 are specific examples of a lock mechanism.

According to the millimeter-wave antenna device 21 (22 to 24) of the embodiment of the present invention, it is configured such that the base connector 31 is fixed to the support substrate 14, the antenna module 81 is fixed such that the front surface of the antenna substrate 82 faces up, and the module connector 51 is fitted in and connected to the base connector 31. Thus, the antenna module 81 can be firmly supported on the support substrate 14 in a state in which the front surface of the antenna substrate 82 faces up. With this configuration, a change in the orientation of the antenna substrate 82 due to, e.g., vibration while the subject vehicle is traveling can be prevented.

Moreover, according to the millimeter-wave antenna device 21 (22 to 24) of the embodiment of the present invention, the RF circuit 84 of the antenna module 81 and the wires formed on the support substrate 14 are electrically connected to each other by fitting connection between the base connector 31 and the module connector 51. Thus, as compared to a case where the RF circuit 84 and the wires formed on the support substrate 14 are electrically connected to each other by soldering manually performed using a soldering gun, impedance mismatch among the RF circuit 84 and the wires formed on the support substrate 14 can be reduced. Specifically, according to a typical method in which the RF circuit 84 and the wires formed on the support substrate 14 are electrically connected to each other by soldering manually performed using the soldering gun, when the millimeter-wave antenna device 21 (22 to 24) is attached to the support substrate 14 upon assembly of the antenna apparatus 1, impedance mismatch among the RF circuit 84 and the wires formed on the support substrate 14 is caused due to an extremely great or small amount of solder on each connection portion among the RF circuit 84 and the wires formed on the support substrate 14. On the other hand, according to the method in which the RF circuit 84 of the antenna module 81 and the wires formed on the support substrate 14 are electrically connected to each other by fitting connection between the base connector 31 and the module connector 51, the terminals of the base connector 31 and the terminals of the module connector 51 reliably constantly contact each other with a certain contact area by fitting between the base connector 31 and the module connector 51. Thus, as compared to soldering with the soldering gun, impedance mismatch among the RF circuit 84 and the wires formed on the support substrate 14 is less likely to occur. That is, the module connector 51 and the base connector 31 are designed and manufactured such that impedance match is made between the RF circuit 84 and the module connector 51, between the module connector 51 and the base connector 31, and between the base connector 31 and each wire on the support substrate 14, so that by attachment of the antenna module 81 to the support substrate 14 by fitting connection between the base connector 31 and the module connector 51, an impedance as designed can be reproduced at each location among the RF circuit 84 and the wires on the support substrate 14 and impedance match as designed can be made between the RF circuit 84 and the module connector 51, between the module connector 51 and the base connector 31, and between the base connector 31 and each wire on the support substrate 14. Thus, according to the millimeter-wave antenna device 21 (22 to 24) of the embodiment of the present invention, e.g., a reflection loss of the transmission signal (the transmission intermediate-frequency signal) or the reception signal (the reception intermediate-frequency signal) can be reduced, the quality of communication using a radio wave with the quasi-millimeter wave band or the millimeter wave band can be improved, and favorable communication can be achieved even in the case of using a radio wave with such an extremely-high frequency.

Note that in the millimeter-wave antenna device 21 (22 to 24), reflow soldering is used as the method for connecting the transmission terminal 37, the reception terminal 38, the separate shield members 39, 40, the power supply terminal 41, the other terminals 42, and the fixing portions 46 of the base connector 31 to the pads 91 to 97 on the support substrate 14 and the method for connecting the transmission terminal 61, the reception terminal 62, the separate shield members 63, 64, the power supply terminal 65, the other terminals 66, and the fixing portions 76 of the module connector 51 to the pads 101 to 107 on the antenna substrate 82. In reflow soldering, the amount of solder to be applied to a pad can be controlled with a high accuracy. Thus, it is less likely to cause an extremely great or small amount of solder as in soldering manually performed using the soldering gun upon assembly of the antenna apparatus 1.

In the millimeter-wave antenna device 21 (22 to 24) of the present embodiment, the base connector 31 includes the transmission terminal 37, the reception terminal 38, the power supply terminal 41, and the other terminals 42, and the module connector 51 includes the transmission terminal 61, the reception terminal 62, the power supply terminal 65, and the other terminals 66. The base connector 31 and the module connector 51 are fitted and connected to each other, and in this manner, these terminals can be connected to each other. Thus, connection among the antenna module 81 and the wires on the support substrate 14 can be facilitated, and a process such as manufacturing, assembly, or repairing of the antenna apparatus 1 or replacement of a millimeter-wave antenna module can be simplified.

In the millimeter-wave antenna device 21 (22 to 24) of the present embodiment, the transmission terminal 37 of the base connector 31 and the transmission terminal 61 of the module connector 51 are separately electromagnetically shielded by the separate shield members 39, 63. Besides, the reception terminal 38 of the base connector 31 and the reception terminal 62 of the module connector 51 are separately electromagnetically shielded by the separate shield members 40, 64. Thus, the effect of reducing mixing of noise with the transmission signal and leakage of the transmission signal to the outside and the effect of reducing mixing of noise with the reception signal and leakage of the reception signal to the outside can be enhanced. Noise due to mixing of the transmission signal with the reception signal and noise due to mixing of the reception signal with the transmission signal can be reduced.

In the millimeter-wave antenna device 21 (22 to 24) of the present embodiment, the overall shield member 43 configured to entirely electromagnetically shield the multiple terminals of the base connector 31 is provided at the base connector 31, and the overall shield member 67 configured to entirely electromagnetically shield the multiple terminals of the module connector 51 is provided at the module connector 51. Thus, for any of various signals transferred among the RF circuit 84 and the wires on the support substrate 14, mixing of noise or leakage to the outside can be reduced. Specifically, for the transmission signal and the reception signal, the effect of reducing mixing of noise or leakage to the outside can be enhanced by double electromagnetic shield of the separate shield members 39, 40, 63, 64 and the overall shield members 43, 67.

According to the millimeter-wave antenna device 21 (22 to 24) of the present embodiment, it is configured such that the module connector 51 is locked to the base connector 31 by the lock mechanism including the spring portions 77, the locking protrusions 78, and the locking holes 48, so that fitting connection between the base connector 31 and the module connector 51 can be held and separation of the base connector 31 and the module connector 51 due to, e.g., vibration while the subject vehicle is traveling can be prevented.

(Another Embodiment of Millimeter-Wave Antenna Device)

Figure 14:
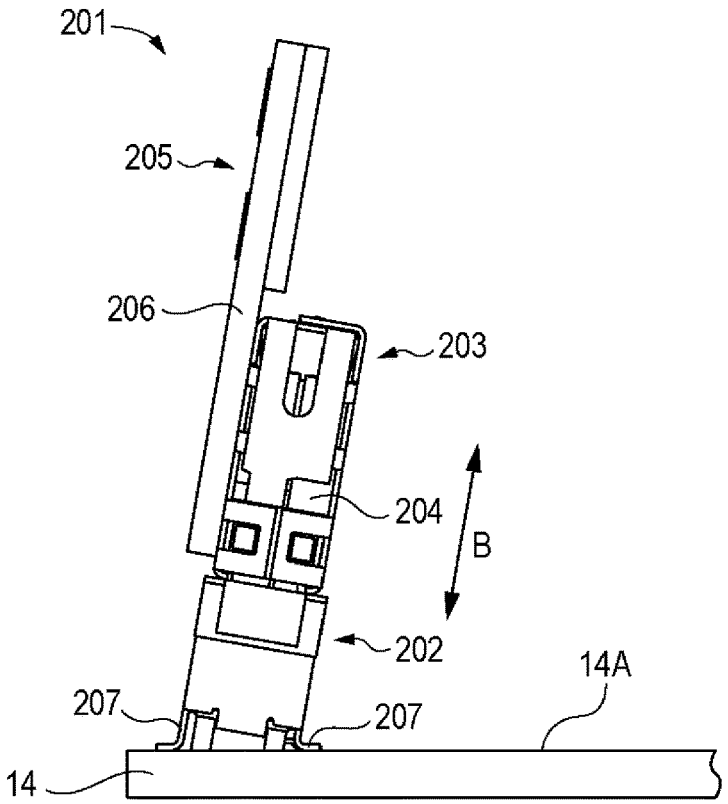
FIG. 14 is a view for describing another embodiment of the antenna device of the present invention.

FIG. 14 shows a millimeter-wave antenna device 201 of another embodiment of the present invention. In the above-described millimeter-wave antenna device 21 (22 to 24), in a state in which the base connector 31 is fixed to the support substrate 14, the fitting portion 36 and the fitting portion 55 are formed such that the insertion/extraction direction A of the module connector 51 with respect to the base connector 31 is perpendicular to the upper surface 14A of the support substrate 14, and the antenna module 81 is fixed to the casing 52 such that the front surface of the antenna substrate 82 is inclined with respect to the insertion/extraction direction A, as shown in FIG. 5. On the other hand, in the millimeter-wave antenna device 201 of another embodiment, in a state in which a base connector 202 is fixed to a support substrate 14, a fitting portion of the base connector 202 and a fitting portion of a module connector 203 are formed such that an insertion/extraction direction B of the module connector 203 with respect to the base connector 202 is inclined with respect to an upper surface 14A of the support substrate 14, and an antenna module 205 is fixed to a casing 204 of the module connector 203 such that a front surface of an antenna substrate 206 is parallel with the insertion/extraction direction B, as shown in FIG. 14. Specifically, among multiple fixing portions 207 for fixing the base connector 202 to the support substrate 14, the fixing portion 207 arranged on the front side of the base connector 202 greatly protrudes downward as compared to a fixing portion 208 arranged on the back side of the base connector 202. With this configuration, the base connector 202 is inclined with respect to the upper surface 14A of the support substrate 14 such that a front surface of the base connector 202 faces diagonally upward. In addition, the amount of protrusion of the fixing portion is equal among the multiple fixing portions for fixing the antenna module 205 to the casing 204 of the module connector 203. With this configuration, the antenna module 205 is fixed to the casing 204 such that the front surface of the antenna substrate 206 is parallel with the surface, which faces the front, of the casing 204 of the module connector 203. With the millimeter-wave antenna device 201 having such a configuration, features and advantageous effects similar to those of the millimeter-wave antenna device 21 (22 to 24) can be obtained.

(Another Embodiment of Antenna Apparatus)

Figure 15:
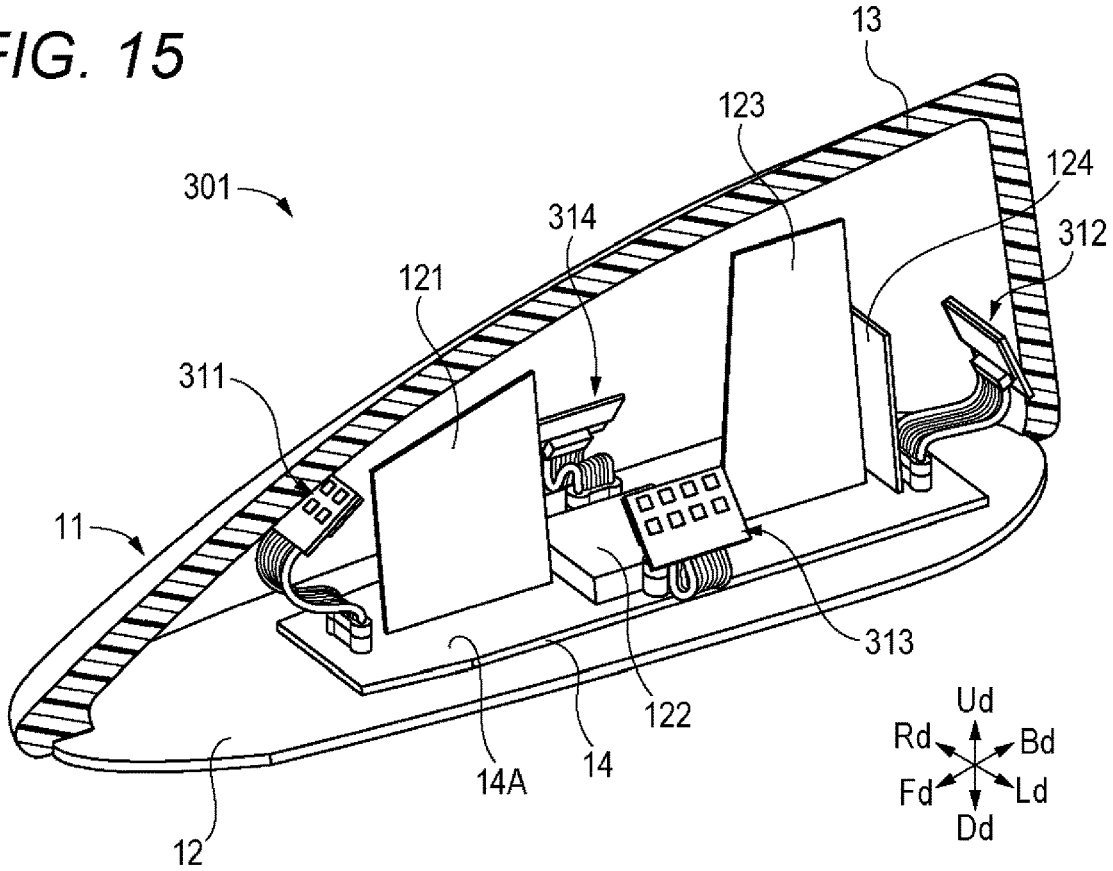
FIG. 15 is a view for describing another embodiment of the antenna apparatus of the present invention.
Figure 16:
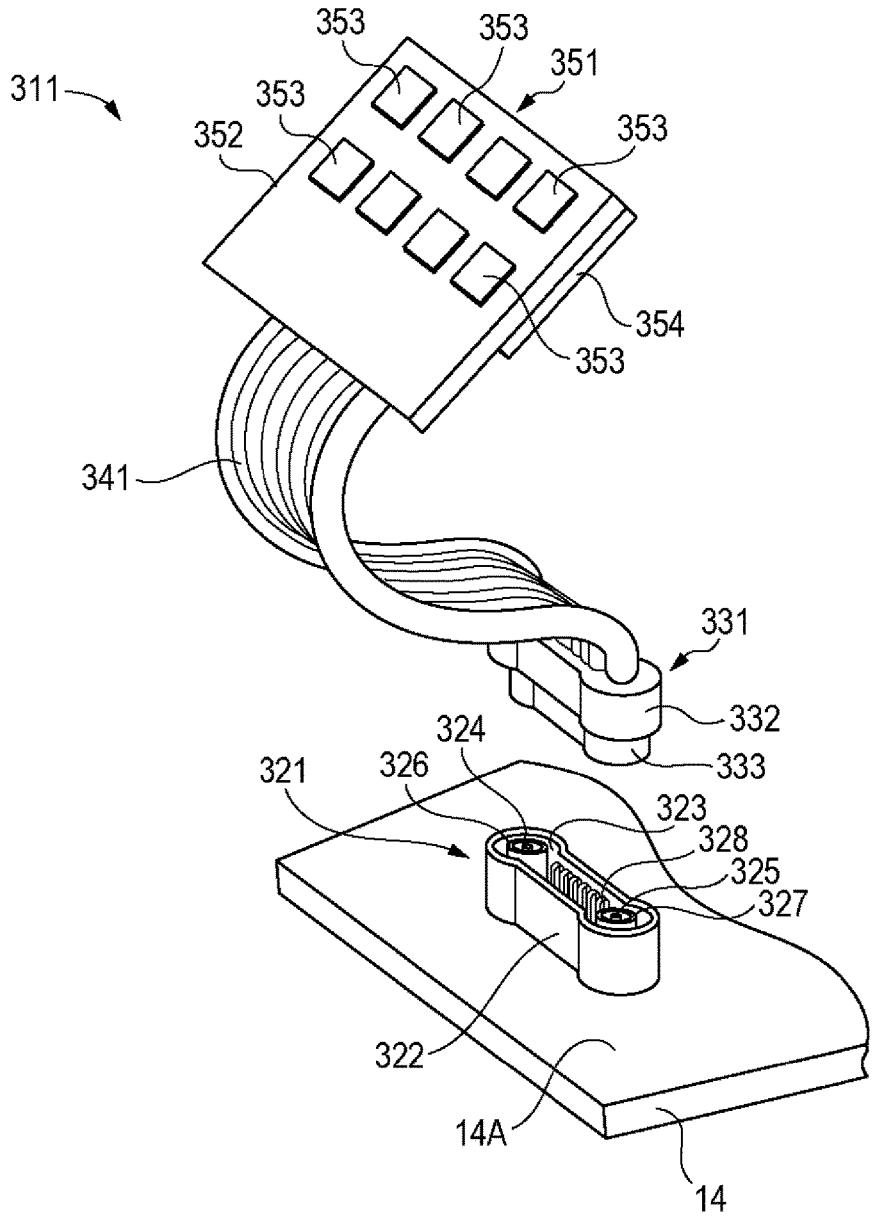
FIG. 16 is a view for describing the millimeter-wave antenna device of FIG. 15.

FIG. 15 shows an antenna apparatus 301 of another embodiment of the present invention. FIG. 16 shows a millimeter-wave antenna device 311 included in the antenna apparatus 301. In the antenna apparatus 301 of FIG. 15, a case, a support substrate, and each non-millimeter-wave antenna device are the same as those of the antenna apparatus 1 of FIG. 1, and therefore, the same reference numerals as those of the antenna apparatus 1 of FIG. 1 will be used and description thereof will be omitted.

As shown in FIG. 16, in the antenna apparatus 301 of the present embodiment, each of the millimeter-wave antenna devices 311 to 314 includes not only a base connector 321 fixed to a support substrate 14, a module connector 331 connected to the base connector 321 to be insertable into or extractable from the base connector 321, and an antenna module 351 configured to transmit or receive a radio wave with a quasi-millimeter wave band or a millimeter wave band, but also a cable 341 connecting the module connector 331 and the antenna module 351 to each other.

The base connector 321 includes a casing 322, a fitting portion 323, a transmission terminal 324, a reception terminal 325, separate shield members 326, 327, a power supply terminal 328, and other terminals. The module connector 331 also includes a casing 332, a fitting portion 333, and terminals and shield members corresponding to the terminals and the shield members included in the base connector 321. Alternatively, an overall shield member may be provided at each of the base connector 321 and the module connector 331.

The cable 341 includes electric wires for connecting the transmission terminal, the reception terminal, the separate shield members, the power supply terminal, and the other terminals of the module connector 331 to an RF circuit 354 of the antenna module 351. Two electric wires for connecting the transmission terminal and the separate shield members of the module connector 331 to the RF circuit 354 preferably have a coaxial cable structure in which an external conductor surrounds an internal conductor via an insulator. Two electric wires for connecting the reception terminal and the separate shield members of the module connector 331 to the RF circuit 354 preferably similarly have the coaxial cable structure.

The antenna module 351 includes an antenna substrate 352, antenna elements 353, and the RF circuit 354. As shown in FIG. 15, the antenna module 351 of each of the millimeter-wave antenna devices 311 to 314 is attached to a case 11 such that a front surface of the antenna substrate 352 faces an inner surface of the case 11 and faces diagonally upward. Specifically, the antenna module 351 of the millimeter-wave antenna device 311 is attached to an inner surface of a front portion of the case 11. The antenna module 351 of the millimeter-wave antenna device 312 is attached to an inner surface of a back portion of the case 11. The antenna module 351 of the millimeter-wave antenna device 313 is attached to an inner surface of a left portion of the case 11. The antenna module 351 of the millimeter-wave antenna device 314 is attached to an inner surface of a right portion of the case 11.

With the antenna apparatus 301 having such a configuration, features and advantageous effects similar to those of the above-described antenna apparatus 1 shown in FIG. 1 can be also obtained.

Note that in each of the above-described embodiments, the number of millimeter-wave antenna devices in the antenna apparatus 1 (301) is four, but the number of millimeter-wave antenna devices provided at the antenna apparatus 1 (301) is not limited to above. For example, two millimeter-wave antenna devices may be provided at the antenna apparatus 1, and these two millimeter-wave antenna devices may be each arranged on the front and back end sides or the right and left end sides in the region of the upper surface 14A of the support substrate 14 outside the region Z. Alternatively, three millimeter-wave antenna devices may be provided at the antenna apparatus 1, and these three millimeter-wave antenna devices may be each arranged on the front, right, and left end sides or the back, right, and left end sides in the region of the upper surface 14A of the support substrate 14 outside the region Z. Alternatively, five or more millimeter-wave antenna devices may be provided at the antenna apparatus 1, and these millimeter-wave antenna devices may be arrayed with proper intervals in the region of the upper surface 14A of the support substrate 14 outside the region Z. The number of non-millimeter-wave antenna devices provided at the antenna apparatus 1 (301) and the type of such a non-millimeter-wave antenna device are not limited to above. The antenna apparatus of the present invention is not limited to the shark fin antenna. The antenna device (the millimeter-wave antenna device) of the present invention may be dedicated to transmission or reception. Arrangement of the antenna elements and the number of antenna elements on the antenna substrate are not limited to above. The number of terminals of the base connector and the module connector is not limited to above. The antenna circuit is not limited to the RF circuit. In the present invention, the antenna circuit (the RF circuit) may be attached not to the antenna substrate but to the support substrate.

The present invention can be changed as necessary without departing from the gist or idea of the invention which can be read from the claims and the entirety of the specification, and these modifications of the antenna device and the antenna apparatus are also included in the technical idea of the present invention.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An antenna device provided on an attachment surface of a support substrate and used for transmitting or receiving a radio wave with a quasi-millimeter wave band or a millimeter wave band, comprising:

a base connector fixed to the support substrate;

a module connector connected to the base connector to be insertable into or extractable from the base connector; and an antenna module fixed to the module connector and configured to transmit or receive the radio wave with the quasi-millimeter wave band or the millimeter wave band, wherein the base connector includes a base-side casing of which a lower end side is fixed to the support substrate, a base-side fitting portion provided on an upper end side of the base-side casing and fitted onto a module-side fitting portion of the module connector, and multiple base-side terminals provided in the base-side casing and connecting a substrate-side circuit provided on the support substrate and multiple module-side terminals of the module connector to each other, the module connector includes a module-side casing, the module-side fitting portion provided on a lower end side of the module-side casing and fitted in the base-side fitting portion, and the multiple module-side terminals provided in the module-side casing and connecting the multiple base-side terminals and the antenna module to each other, the antenna module includes an antenna substrate, and an antenna element provided on a front surface of the antenna substrate and configured to transmit or receive the radio wave with the quasi-millimeter wave band or the millimeter wave band, and in a state in which the base connector is fixed to the support substrate and the module connector is connected to the base connector, the antenna module is fixed to the module-side casing such that the front surface of the antenna substrate faces up diagonally to an outside of the module connector.

2. The antenna device according to claim 1, wherein in a state in which the base connector is fixed to the support substrate, the base-side fitting portion and the module-side fitting portion are formed such that an insertion/extraction direction of the module connector with respect to the base connector is perpendicular to the attachment surface of the support substrate, and the antenna module is fixed to the module-side casing such that the front surface of the antenna substrate is inclined with respect to the insertion/extraction direction.

3. The antenna device according to claim 1, wherein in a state in which the base connector is fixed to the support substrate, the base-side fitting portion and the module-side fitting portion are formed such that an insertion/extraction direction of the module connector with respect to the base connector is inclined with respect to the attachment surface of the support substrate, and the antenna module is fixed to the module-side casing such that the front surface of the antenna substrate is parallel with the insertion/extraction direction.

4. The antenna device according to claim 1, wherein the antenna module includes an antenna circuit provided on the antenna substrate and configured to perform signal processing relating to transmission or reception of the radio wave with the quasi-millimeter wave band or the millimeter wave band, and the multiple base-side terminals include a base-side transmission terminal for transferring a transmission signal from the substrate-side circuit to the antenna circuit, a base-side reception terminal for transferring a reception signal from the antenna circuit to the substrate-side circuit, and a base-side power supply terminal for supplying power from the substrate-side circuit to the antenna circuit, and the multiple module-side terminals include a module-side transmission terminal for transferring a transmission signal from the substrate-side circuit to the antenna circuit, a module-side reception terminal for transferring a reception signal from the antenna circuit to the substrate-side circuit, and a module-side power supply terminal for supplying power from the substrate-side circuit to the antenna circuit.

5. The antenna device according to claim 4, wherein the base connector includes a first base-side separate shield member made of a conductive material and surrounding an outer peripheral side of the base-side transmission terminal to separately electromagnetically shield the base-side transmission terminal, and a second base-side separate shield member made of a conductive material and surrounding an outer peripheral side of the base-side reception terminal to separately electromagnetically shield the base-side reception terminal, and the module connector includes a first module-side separate shield member made of a conductive material and surrounding an outer peripheral side of the module-side transmission terminal to separately electromagnetically shield the module-side transmission terminal, and a second module-side separate shield member made of a conductive material and surrounding an outer peripheral side of the module-side reception terminal to separately electromagnetically shield the module-side reception terminal.

6. The antenna device according to claim 1, wherein the base-side casing is made of an insulating material and is provided with a base-side overall shield member made of a conductive material and collectively covering the multiple base-side terminals to entirely electromagnetically shield the multiple base-side terminals, and the module-side casing is made of an insulating material and is provided with a module-side overall shield member made of a conductive material and collectively covering the multiple module-side terminals to entirely electromagnetically shield the multiple module-side terminals.

7. The antenna device according to claim 1, further comprising:

a lock mechanism configured to lock, when the base-side fitting portion and the module-side fitting portion are fitted to each other, the module connector to the base connector such that the module connector is not separated from the base connector.

8. An antenna apparatus provided at a vehicle and used for radio communication between a communication apparatus provided at the vehicle and a communication apparatus provided at an object other than the vehicle, comprising:

a support substrate;

multiple antenna devices provided on an attachment surface of the support substrate; and a case housing the support substrate and the multiple antenna devices, wherein the multiple antenna devices include multiple millimeter-wave antenna devices configured to transmit or receive a radio wave with a quasi-millimeter wave band or a millimeter wave band, and a non-millimeter-wave antenna device configured to transmit or receive a radio wave with a frequency band lower than the quasi-millimeter wave band, each of the multiple millimeter-wave antenna devices is the antenna device according to claim 1, and the multiple millimeter-wave antenna devices are, on the attachment surface of the support substrate, arranged in a region outside a region where the non-millimeter-wave antenna device is arranged.

9. The antenna apparatus according to claim 8, wherein:

the multiple millimeter-wave antenna devices include a first millimeter-wave antenna device, a second millimeter-wave antenna device, a third millimeter-wave antenna device, and a fourth millimeter-wave antenna device; the first millimeter-wave antenna device is arranged at a front of the non-millimeter-wave antenna device; the second millimeter-wave antenna device is arranged at a back of the non-millimeter-wave antenna device; the third millimeter-wave antenna device is arranged at a left of the non-millimeter-wave antenna device; and the fourth millimeter-wave antenna device is arranged at a right of the non-millimeter-wave antenna device.

10. The antenna apparatus according to claim 8, wherein:

the multiple millimeter-wave antenna devices include a first millimeter-wave antenna device, a second millimeter-wave antenna device, a third millimeter-wave antenna device, and a fourth millimeter-wave antenna device; the first millimeter-wave antenna device is arranged on a frontmost side among the multiple antenna devices; the second millimeter-wave antenna device is arranged on a backmost side among the multiple antenna devices; the third millimeter-wave antenna device is arranged on a leftmost side among the multiple antenna devices; and the fourth millimeter-wave antenna device is arranged on a rightmost side among the multiple antenna devices.

11. An antenna apparatus provided at a vehicle and used for radio communication between a communication apparatus provided at the vehicle and a communication apparatus provided at an object other than the vehicle, comprising:

a support substrate;

multiple millimeter-wave antenna devices configured to transmit or receive a radio wave with a quasi-millimeter wave band or a millimeter wave band; and a case housing the support substrate and the multiple millimeter-wave antenna devices, wherein each millimeter-wave antenna device includes a base connector fixed to the support substrate, a module connector connected to the base connector to be insertable into or extractable from the base connector, an antenna module configured to transmit or receive the radio wave with the quasi-millimeter wave band or the millimeter wave band, and a cable connecting the module connector and the antenna module to each other, the base connector includes a base-side casing of which a lower end side is fixed to the support substrate, a base-side fitting portion provided on an upper end side of the base-side casing and fitted onto a module-side fitting portion of the module connector, and multiple base-side terminals provided in the base-side casing and connecting a substrate-side circuit provided on the support substrate and multiple module-side terminals of the module connector to each other, the module connector includes a module-side casing, the module-side fitting portion provided on a lower end side of the module-side casing and fitted in the base-side fitting portion, and the multiple module-side terminals provided in the module-side casing and connecting the multiple base-side terminals and multiple electric wires of the cable to each other, the cable includes the multiple electric wires connecting the multiple module-side terminals and the antenna module to each other, the antenna module includes an antenna substrate, and an antenna element provided on a front surface of the antenna substrate and configured to transmit or receive the radio wave with the quasi-millimeter wave band or the millimeter wave band, and the antenna module of each millimeter-wave antenna device is attached to the case such that the front surface of the antenna substrate faces an inner surface of the case and faces diagonally upward.

* * * * *